US011587401B2

(12) United States Patent
Hayashi et al.

(10) Patent No.: US 11,587,401 B2
(45) Date of Patent: Feb. 21, 2023

(54) INFORMATION PROCESSING SYSTEM, STORAGE MEDIUM HAVING STORED THEREIN INFORMATION PROCESSING PROGRAM, INFORMATION PROCESSING APPARATUS, AND INFORMATION PROCESSING METHOD

(71) Applicant: NINTENDO CO., LTD., Kyoto (JP)

(72) Inventors: Yugo Hayashi, Kyoto (JP); Kosuke Yabuki, Kyoto (JP); Masayuki Okada, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 241 days.

(21) Appl. No.: 17/002,227

(22) Filed: Aug. 25, 2020

(65) Prior Publication Data

US 2021/0090400 A1 Mar. 25, 2021

(30) Foreign Application Priority Data

Sep. 19, 2019 (JP) ..... JP2019-170650

(51) Int. Cl.
*G07F 17/32* (2006.01)

(52) U.S. Cl.
CPC ..... *G07F 17/3262* (2013.01); *G07F 17/3211* (2013.01); *G07F 17/3244* (2013.01); *G07F 17/3267* (2013.01)

(58) Field of Classification Search
CPC ..... G07F 17/3262; G07F 17/3211; G07F 17/3244; G07F 17/3267
See application file for complete search history.

(56) References Cited

U.S. PATENT DOCUMENTS 8,808,093 B1 * 8/2014 Reynolds ..... A63F 13/822 463/43
2017/0182420 A1 * 6/2017 Bambino ..... A63F 13/825

OTHER PUBLICATIONS

"[T Super Mario 3D Land] Manual", [online], Nintendo of America Inc., [searched on Sep. 10, 2019], internet (URL: https://www.nintendo.com/consumer/gameslist/manuals/3DS_super_mario_3d_land_en.pdf), 5 pages.

* cited by examiner

*Primary Examiner* — Tramar Harper
*Assistant Examiner* — Jeffrey K Wong
(74) *Attorney, Agent, or Firm* — Nixon & Vanderhye PC

(57) ABSTRACT

A plurality of placement objects including first objects representing game events of a first type and a second object representing a game event of a second type are placed in a placement order in a game space, in the game event of the second type permitted to be executed, if a first giving condition is satisfied, a first reward is given to a user, and if a second giving condition is satisfied, a second reward is given to the user, and if the first reward is given to the user, a placement order of the first objects only is not changed, and placement of the second object representing the game event of the second type in which the first reward is given to the user is changed to a position before the first one of the first objects or after the last one of the first objects.

21 Claims, 15 Drawing Sheets

INFORMATION PROCESSING SYSTEM, STORAGE MEDIUM HAVING STORED THEREIN INFORMATION PROCESSING PROGRAM, INFORMATION PROCESSING APPARATUS, AND INFORMATION PROCESSING METHOD

CROSS REFERENCE TO RELATED APPLICATION

The disclosure of Japanese Patent Application No. 2019-170650, filed on Sep. 19, 2019, is incorporated herein by reference.

FIELD

The technology shown here relates to an information processing system, a storage medium having stored therein an information processing program, an information processing apparatus, and an information processing method, and in particular, relates to an information processing system, a storage medium having stored therein an information processing program, an information processing apparatus, and an information processing method that, for example, perform the process of executing a game event.

BACKGROUND AND SUMMARY

Conventionally, in a game where an event selected from a course selection screen is played, a placement object representing an event where normal play is performed, a placement object representing an event where a reward can be acquired, and the like are displayed side by side on the course selection screen. Then, if the event where a reward can be acquired is cleared, the event may become unable to be played again. In some event, to play the event, it is necessary to clear an event represented by a placement object or collect points that can be gained in an event where normal play is performed.

In the above game, however, if a situation is assumed where in the event where a reward can be gained, some of rewards that can be gained in the event are gained, and if the placement object representing the event continues to be displayed at the same position, it is possible that it is difficult to select a placement object representing another event.

Therefore, it is an object of an exemplary embodiment to provide an information processing system, a storage medium having stored therein an information processing program, an information processing apparatus, and an information processing method that are capable of improving the convenience of selection of a placement object.

To achieve the above object, the exemplary embodiment can employ, for example, the following configurations. It should be noted that it is understood that, to interpret the descriptions of the claims, the scope of the claims should be interpreted only by the descriptions of the claims. If there is a conflict between the descriptions of the claims and the descriptions of the specification, the descriptions of the claims take precedence.

In an exemplary configuration of an information processing system according to the exemplary embodiment, an information processing system includes a computer configured to: place a plurality of placement objects each including first objects representing one of a plurality of game events of a first type and a second object representing at least one game event of a second type in a placement order in a game space; generate an image including at least some of the placed plurality of placement objects to be displayed on a display screen; at least based on satisfaction of an event accomplishment condition set for the game events of the first type or satisfaction of a subevent accomplishment condition set for subevents included in the game events of the first type, permit execution of the at least one game event of the second type; and in the game event of the second type permitted to be executed, if a first giving condition is satisfied, give a first reward to a user, and if a second giving condition is satisfied, give a second reward to the user. The placement of the plurality of placement objects includes, if the first reward is given to the user, not changing a placement order of the first objects only, and changing placement of the second object representing the game event of the second type in which the first reward is given to the user to a position before the first one of the first objects or after the last one of the first objects in the placement order.

Based on the above, the placement of a second object representing a game event of a second type where a first reward is given to a user is changed to a position before the first one of first objects or after the last one of the first objects in a placement order. Thus, it is easier to select a placement object representing another event than in a case where the second object continues to be displayed at the same placement position. Thus, it is possible to improve the convenience of selection of a placement object.

The giving of the reward may include, at least under the condition that the execution of the game event of the second type is permitted, determining that the first giving condition is satisfied.

Based on the above, it is possible to easily satisfy a first giving condition.

Even if the event accomplishment condition set for the game events of the first type is satisfied, or the subevent accomplishment condition set for the subevents included in the game events of the first type is satisfied, the placement order of the first objects only that represent the game events of the first type may not be changed.

Based on the above, the placement order of the first objects representing game events of a first type is not changed. Thus, it is possible to improve the convenience of repeated execution of the game events of the first type.

The placement of the plurality of placement objects may include, if a plurality of the second objects are placed in the game space, and the first giving condition is satisfied in each of a plurality of the game events of the second type, changing the placement so that the plurality of the second objects each representing one of the game events of the second type are adjacent to each other in an area before the first one of the first objects or an area after the last one of the first objects.

Based on the above, second objects representing game events of the second type satisfying a first giving condition are collectively displayed. Thus, it is possible to improve the convenience of execution of an event represented by a placement object other than the second objects representing the game events of the second type satisfying the first giving condition.

The computer may be further caused to, in the placement of the plurality of placement objects, place the plurality of first objects in ascending order of a number of a parameter required to permit execution of each of the game events of the first type represented by the plurality of first objects. The computer may be further caused to, at least based on satisfaction of the event accomplishment condition set for any of the game events of the first type or the subevent accomplishment condition, change the number of the parameter corresponding to each of the plurality of first objects.

Based on the above, the first objects are placed in ascending order of a number of a parameter required to permit the execution of each of the game events of the first type. Thus, it is easy to distinguish a game event of the first type likely to be permitted to be executed. Thus, it is easy to grasp a parameter required to execute a game event of the first type.

The permission of the execution may include, based on the number of the parameter associated with each of users, permitting execution of at least one of the game events of the first type.

Based on the above, it is possible to set a game event of the first type that can be executed with respect to each user.

The permission of the execution may include, at least based on the parameter that changes due to satisfaction of the event accomplishment condition set for the game event of the first type represented by any of the first objects placed on a side where a required number of the parameter is smaller in the placement order, or satisfaction of the subevent accomplishment condition set for the subevent included in the game event of the first type, permitting execution of the game event of the first type represented by any of the first objects placed on a side where the required number of the parameter is greater in the placement order and the game event of the second type represented by the second object.

Based on the above, it is possible to execute events based on the placement order of placement objects.

The generation of the image may include giving an image indicating a number that should be satisfied by the parameter for permitting the execution associated with each of the placed plurality of placement objects to each of the placement objects, thereby generating an image to be displayed on the display screen.

Based on the above, it is possible to configure a group of events in which an event set on the side where a required number of a parameter is smaller in the placement order is executed, thereby enabling the execution of an event placed on the side where the required number of the parameter is greater in the placement order.

The placement of the plurality of placement objects may include placing the second objects representing the game events of the second type satisfying the first giving condition in ascending order of a number of a parameter required to permit execution of each of the game events of the second type represented by the second objects, in an area before the first one of the first objects or an area after the last one of the first objects.

Based on the above, even in a case where a first giving condition is satisfied, it is possible to present second objects representing game events of the second type to the user by sequencing the second objects based on the order of a required number of a parameter.

The placement of the plurality of placement objects may include placing the plurality of placement objects in a line in the game space.

Based on the above, it is possible to present the placement order of placement objects in an easily understandable manner.

The game events of the first type may be permitted to be executed multiple times.

Based on the above, in an environment where game events of a first type can be executed multiple times, the effect of further changing the placement position of the second object becomes greater.

The generation of the image may include generating an image including some of the plurality of placement objects to be displayed on the display screen by scrolling a display position on the display screen of a series of image groups of the plurality of placement objects relative to the display screen in accordance with a user operation.

Based on the above, it is possible to configure all a plurality of placement objects to be displayed by scrolling the plurality of placement objects, and it is also possible to give priority to the display of a necessary placement object.

The giving of the reward may include, after the placement of the second object is changed to the position before the first one of the first objects or after the last one of the first objects, and if the second giving condition in the game event of the second type represented by the second object is satisfied, giving the second reward in the game event of the second type to the user.

Based on the above, it is possible to separately give a second reward to the user.

The placement of the plurality of placement objects may include, after the placement of the second object is changed to the position before the first one of the first objects or after the last one of the first objects, and if the second giving condition in the game event of the second type represented by the second object is satisfied, not changing a position of the second object in the placement order.

Based on the above, even after both the first reward and a second reward are given, it is possible to present the second object representing the game event of the second type in an easily understandable manner.

The giving of the reward may include, in a period when a right given to the user is validated by the user paying an equivalent, determining that the second giving condition for the user is satisfied.

Based on the above, the user can receive a second reward by paying an equivalent.

The placement of the plurality of placement objects may include placing the second objects representing the game events of the second type in a display form in which with respect to each of the game events of the second type, it is visually distinguished whether or not the second giving condition is satisfied.

Based on the above, it is possible to visually distinguish the satisfaction of a second giving condition.

The giving of the reward may include setting a time limit for giving the first reward and/or the second reward to the user for each of the game events of the second type.

Based on the above, it is possible to urge the user to acquire the first reward and/or a second reward.

The generation of the image may include, in representation performed after the event accomplishment condition set for the game events of the first type or the subevent accomplishment condition is accomplished, generating an image for displaying the first objects representing the game events of the first type accomplishing the event accomplishment condition or the subevent accomplishment condition at least in the display screen.

Based on the above, the convenience of execution of a game event accomplishing an event accomplishment condition or a subevent accomplishment condition is improved.

The generation of the image may include generating an image such that the placement of the second object is changed to the position before the first one of the first objects or after the last one of the first objects is outside the display screen.

Based on the above, a placement object that is used less frequently is removed from a display range, whereby it is possible to preferentially display a placement object that is used frequently.

The game events of the first type may include a plurality of game stages corresponding to the respective subevents.

Based on the above, it is possible to configure a variety of game events.

The exemplary embodiment may be carried out in the forms of a storage medium having stored therein an information processing program, an information processing apparatus, and an information processing method.

Based on the exemplary embodiment, it is possible to improve the convenience of selection of a placement object.

These and other objects, features, aspects and advantages of the exemplary embodiments will become more apparent from the following detailed description of the exemplary embodiments when taken in conjunction with the accompanying drawings.

DETAILED DESCRIPTION OF NON-LIMITING EXAMPLE EMBODIMENTS

Figure 1:
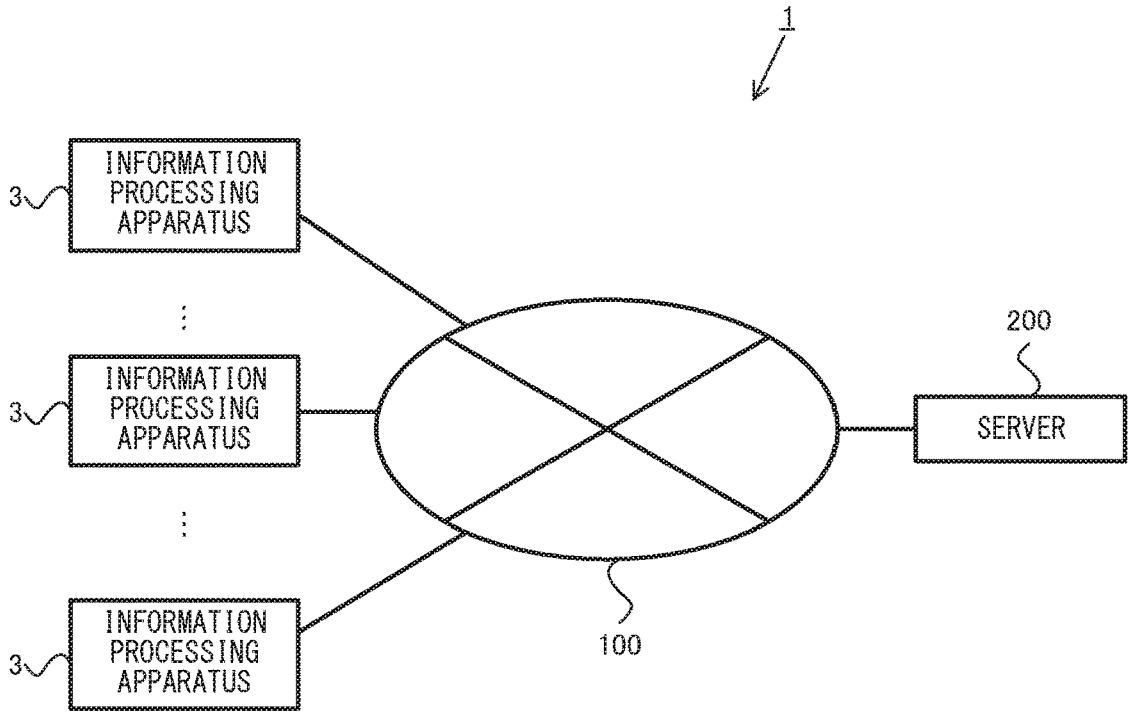
FIG. 1 is a diagram showing a non-limiting example of an information processing system 1 according to an exemplary embodiment.

With reference to FIG. 1, an information processing system according to an exemplary embodiment is described. As shown in FIG. 1, an information processing system 1, which is an example of the information processing system, is constructed by the connections between information processing apparatuses 3 and a server 200 via a network 100. Although FIG. 1 shows a plurality of information processing apparatuses 3, a single information processing apparatus 3 may be included in the information processing system 1.

Each information processing apparatus 3 is configured to connect to the network 100 using wireless or wired communication and forms a client/server system with the server 200. For example, the information processing apparatus 3 can execute a predetermined application (e.g., a game application). The information processing apparatus 3 establishes a connection with the server 200 via the network 100 by executing the predetermined application, and thereby can communicate with the server 200. For example, the information processing apparatus 3 can execute an information processing program stored in a storage medium such as an exchangeable memory card or an exchangeable optical disk, or received from another apparatus. The information processing apparatus 3 may be a device such as a general personal computer, a stationary game apparatus, a mobile phone, a handheld game apparatus, or a PDA (Personal Digital Assistant).

Figure 2:
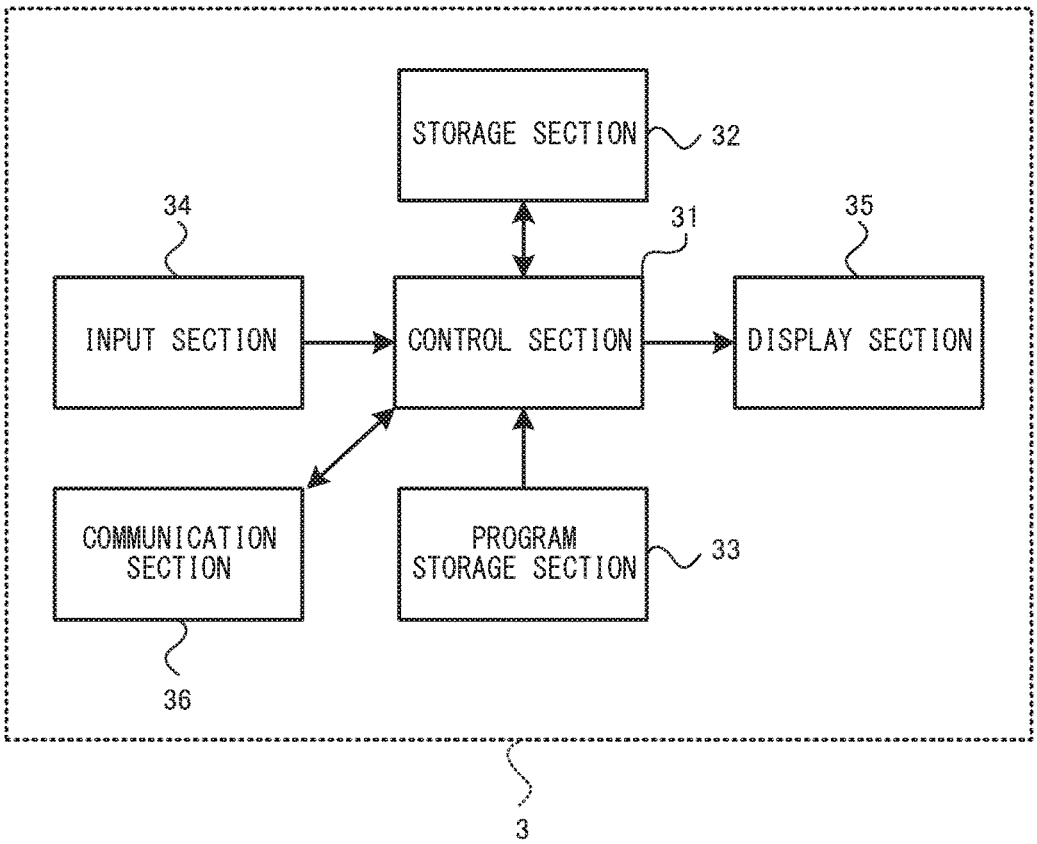
FIG. 2 is a block diagram showing a non-limiting example of the configuration of an information processing apparatus 3.

Next, with reference to FIG. 2, the information processing apparatus 3 is described. FIG. 2 is a block diagram showing an example of the configuration of the information processing apparatus 3. In FIG. 2, the information processing apparatus 3 includes a control section 31, a storage section 32, a program storage section 33, an input section 34, a display section 35, and a communication section 36. The information processing apparatus 3 may be composed of one or more apparatuses including: an information processing apparatus having at least the control section 31; and another apparatus.

The control section 31 is information processing means (a computer) for performing various types of information processing, and is, for example, a CPU. For example, the control section 31 has the functions of executing the application to perform game processing described later, data transmission/reception process via the server 200, and the like, as the various types of information processing. For example, the above functions of the control section 31 are achieved, for example, by the CPU executing a predetermined program.

The storage section 32 stores various pieces of data used when the control section 31 performs the above information processing. The storage section 32 is, for example, a memory accessible by the CPU (the control section 31).

The program storage section 33 stores a program. The program storage section 33 may be any storage device (storage medium) accessible by the control section 31. For example, the program storage section 33 may be a storage device provided in the information processing apparatus having the control section 31, or may be a storage medium detachably attached to the information processing apparatus having the control section 31. Alternatively, the program storage section 33 may be a storage device (a server or the like) connected to the control section 31 via a network. The control section 31 (the CPU) may read part or all of a game program to the storage section 32 at appropriate timing and execute the read program.

The input section 34 is an input apparatus that can be operated by a user. The input section 34 may be any input apparatus. As an example, the input section 34 may be a touch panel provided on a screen of the display section 35. For example, the touch panel may be of any type, and may be of a type that allows a multi-touch input (e.g., a capacitive type) or of a type that allows a single-touch input (e.g., a resistive type). If the information processing apparatus 3 is a stationary game apparatus or a mobile game apparatus as described above, the input section 34 may be a hand-held game controller connected to the stationary game apparatus or the mobile game apparatus. In this case, the input section 34 may be an operation section such as an operation button, an operation key, a joystick, or a slide pad provided in the game controller, or may be an inertial sensor for detecting the orientation or the motion of a game controller main body, or an imaging camera for capturing the periphery of the game controller main body.

The display section 35 displays an image in accordance with an instruction from the control section 31. If the information processing apparatus 3 is composed of a stationary game apparatus or a personal computer, the display section 35 may be composed separately from the information processing apparatus 3.

The communication section 36 is composed of a predetermined communication module. The communication section 36 transmits and receives data to and from another device (e.g., the server 200) via the network 100, and transmits and receives data to and from the other information processing apparatuses 3.

Figure 3:
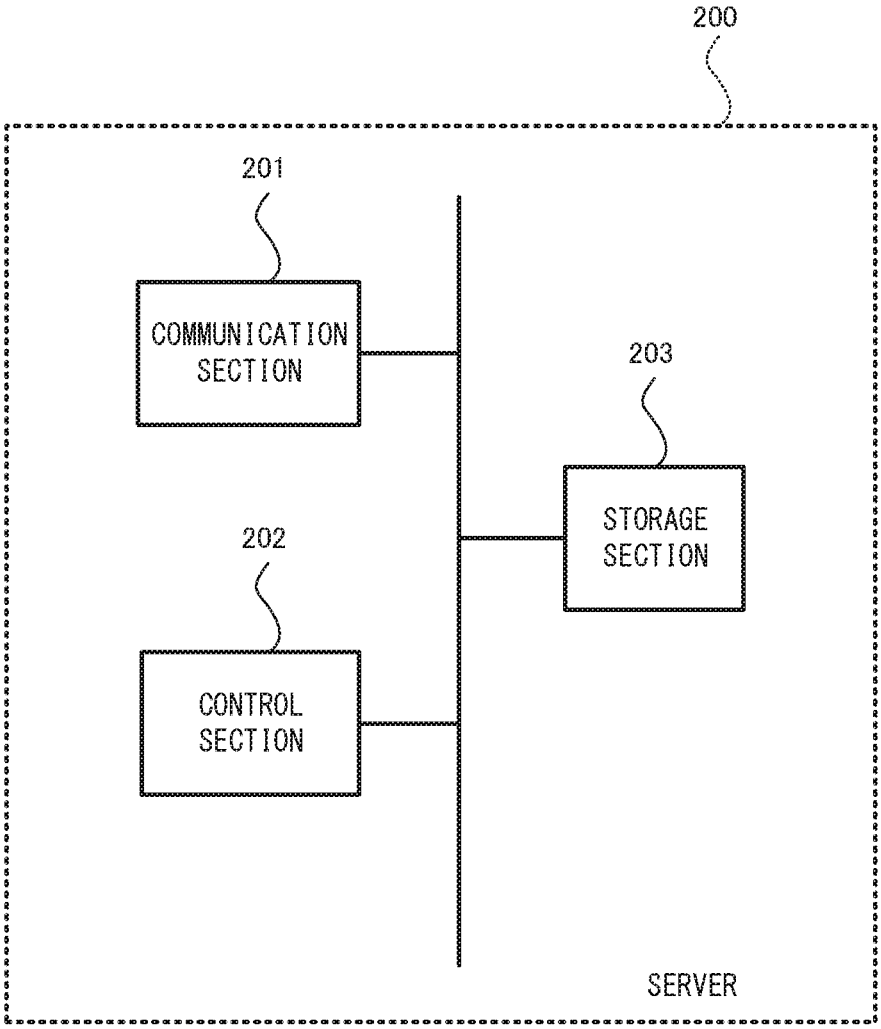
FIG. 3 is a block diagram showing a non-limiting example of the configuration of a server 200.

Next, with reference to FIG. 3, the server 200 is described. FIG. 3 is a block diagram showing an example of the configuration of the server 200.

The server 200 includes a communication section 201, a control section 202, and a storage section 203. The communication section 201 transmits and receives communication packets, thereby communicating with the information processing apparatuses 3 and the like via the network 100. As an example, the control section 202 manages the progress of a game performed with each information processing apparatus 3, manages a right acquired by the user, manages a game item (game points) acquired by the user, manages a gift that can be acquired by the user, manages a gift already acquired by the user, performs the process of managing in-game currency and a game object (e.g., equipment used in the game) to be purchased by the user, performs the process of managing the probability of winning a slot lottery, performs the process of managing information regarding charging, establishes a communication link with the information processing apparatus 3 or the like via the communication section 201, and controls data transmission and selects a path in the network 100. In a case where the server 200 performs a game with a plurality of information processing apparatuses 3, the control section 202 manages the combination of the information processing apparatuses 3 with which the server 200 performs the game, and data communication between the information processing apparatuses 3. The storage section 203 stores: a program to be executed by the control section 202; various pieces of data necessary for the above processes; various pieces of data necessary for communication with the information processing apparatuses 3; and the like. If the system requires a predetermined login process for data transmission and reception using the network 100, the system may perform an authentication process for determining whether or not a user attempting to log in to the server 200 is an authorized user. The server 200 may be composed of a single server machine, or may be composed of a plurality of server machines.

Figure 4:
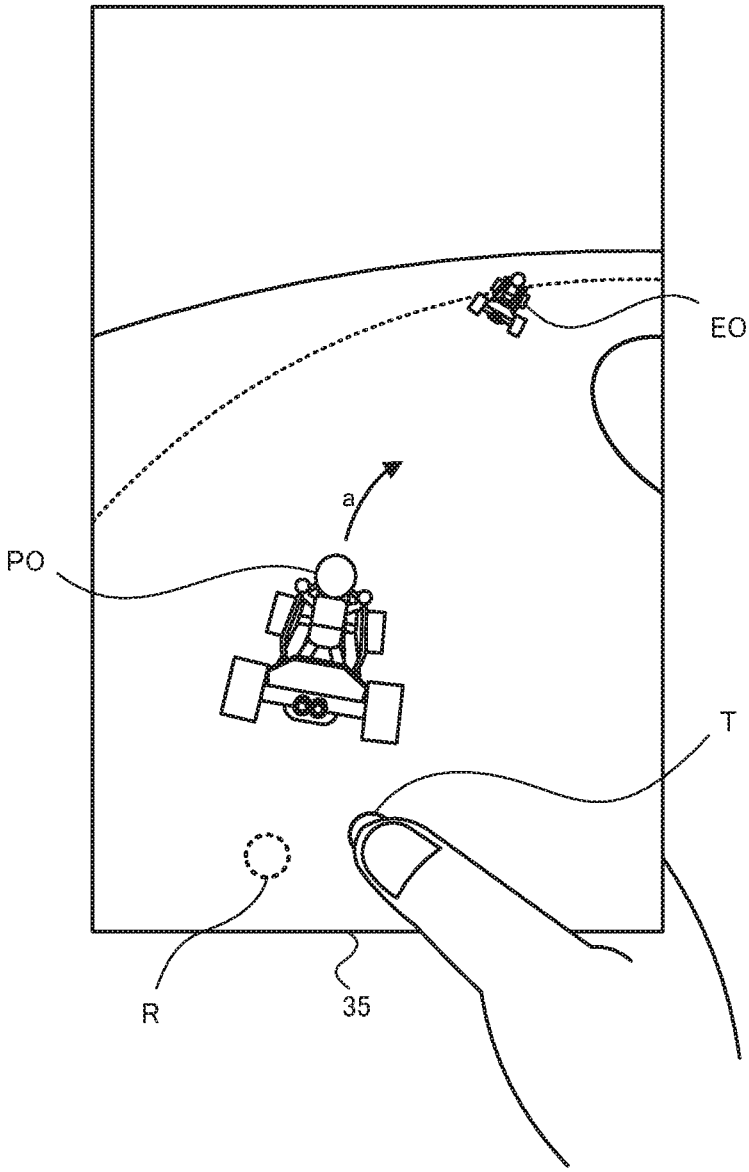
FIG. 4 is a diagram showing a non-limiting example of cup event (an event including a plurality of subevents) representation in a game image displayed on a display section 35 of the information processing apparatus 3.

Next, before specific processing performed by each information processing apparatus 3 and the server 200 is described, a description is given of an overview of game processing performed by the information processing system 1 with reference to FIG. 4. FIG. 4 is a diagram showing an example of cup event (an event including a plurality of subevents) representation in a game image displayed on the display section 35 of the information processing apparatus 3. In the following description, a game is used as an example of an application executed by the information processing apparatus 3. Alternatively, another application may be executed by the information processing apparatus 3.

In FIG. 4, the display section 35 of the information processing apparatus 3 displays a game image corresponding to a game that is being played using the information processing apparatus 3. As an example of cup event (an event including a plurality of subevents) representation in the game, a single scene is displayed where a player character PO performs a racing game. For example, in the above cup event representation, the player character PO moves by riding a vehicle object. The player character PO runs on a course provided in a virtual space. On the above course, an enemy object EO riding another vehicle object also runs. The player character PO and the enemy object EO contend for the rankings until the player character PO and the enemy object EO reach a goal provided on the course. Then, a virtual camera for generating a game image is placed along the course behind the player character PO in accordance with the running of the player character PO. If the virtual camera is directed in a different direction from the running direction in the course due to the spin or the drift of the player character PO, the virtual camera may be always placed at the position of viewing the player character PO from behind the player character PO, or may be placed at the position of viewing the player character PO from behind in the running direction along the course.

As shown in FIG. 4, by performing a touch operation on the touch panel (an example of the input section 34) provided on the screen of the display section 35, it is possible to control the moving direction of the player character PO. As an example, the player character PO is controlled to automatically run forward along the course, but is configured to enable a steering wheel operation in the left/right moving direction of the player character PO by a user operation. Specifically, if a touch operation for swiping in the right direction is performed with respect to a touch position where a touch-on is performed on the touch panel, the player character PO changes the moving direction to the right. If a touch operation for swiping in the left direction is performed with respect to a touch position where a touch-on is performed on the touch panel, the player character PO changes the moving direction to the left. For example, in FIG. 4, the display section 35 displays a reference image R indicating a touch position where a touch-on is performed on the touch panel, and a touch position image T indicating the current touch position. Since the touch position image T is placed in the right direction of the reference image R, the player character PO changes the moving direction to the right (a direction a shown in FIG. 4).

If the racing game ends due to the fact that the player character PO reaches the goal, a game score and gained points corresponding to the ranking of the player character PO, the action of the player character PO during the race (an in-game event), and the like are calculated. Then, if the user reaches the goal at a predetermined ranking or higher in the racing game, it is determined that the racing game (a subevent) is cleared (conquered). Here, the score and the gained points in the racing game are calculated based on the action of the player character PO during the racing game. For the gained points (star points described below), the number of points that can be gained may be set with respect to each race (each subevent). In this case, the user repeats the play of the race (the subevent) and thereby can acquire gained points in an accumulated manner so that the gained points acquired by the user reach the number of points that can be gained. Then, if the user acquires gained points up to the number of points that can be gained set for the racing game (the subevent), it is determined that the racing game (the subevent) is completed (completely conquered). In a cup event including a plurality of racing games (subevents), if all the subevents included in the cup event enter cleared states, it is determined that the cup event is cleared (conquered). If all the subevents included in the cup event enter completed states, it is determined that the cup event is completed (completely conquered). In the exemplary embodiment, even in the state where a subevent or a cup event is cleared, the subevent or the cup event can be repeatedly played. By repeating the play, gained points can be further accumulated in the subevent or the cup event.

Figure 5:
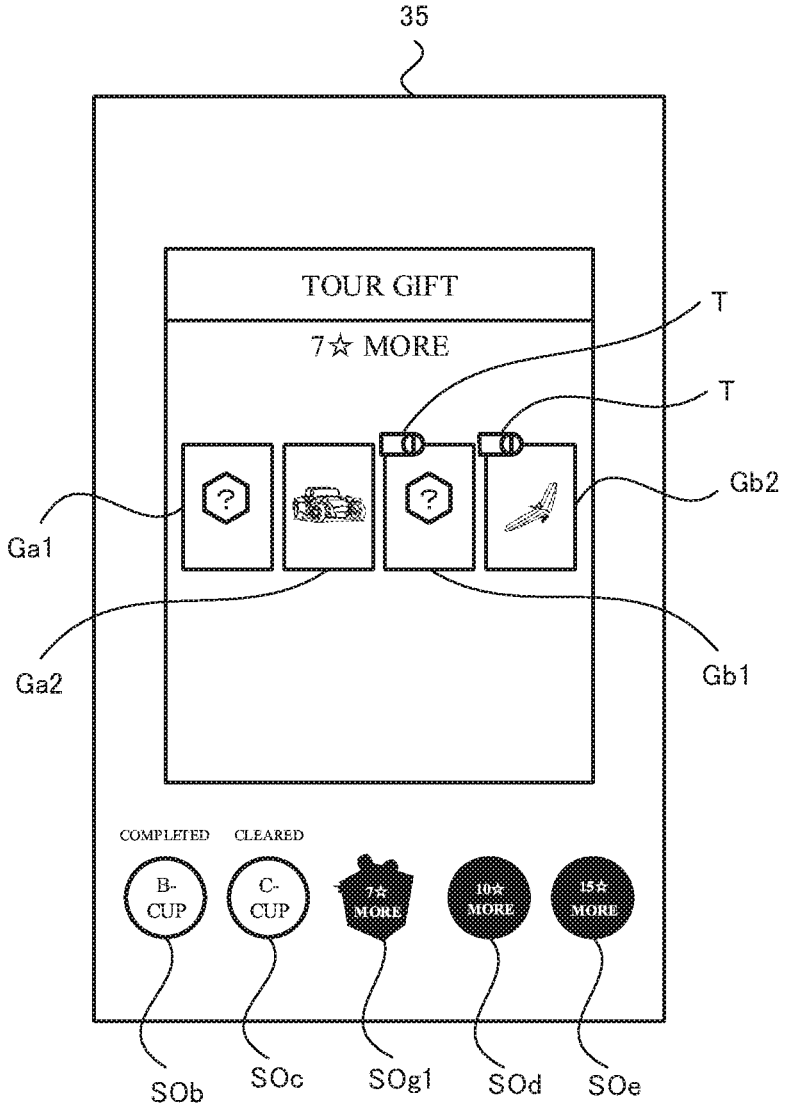
FIG. 5 is a diagram showing a non-limiting example of a game image in which placement objects SO representing events that can be played based on gained points (star points) of a user are displayed.
Figure 6:
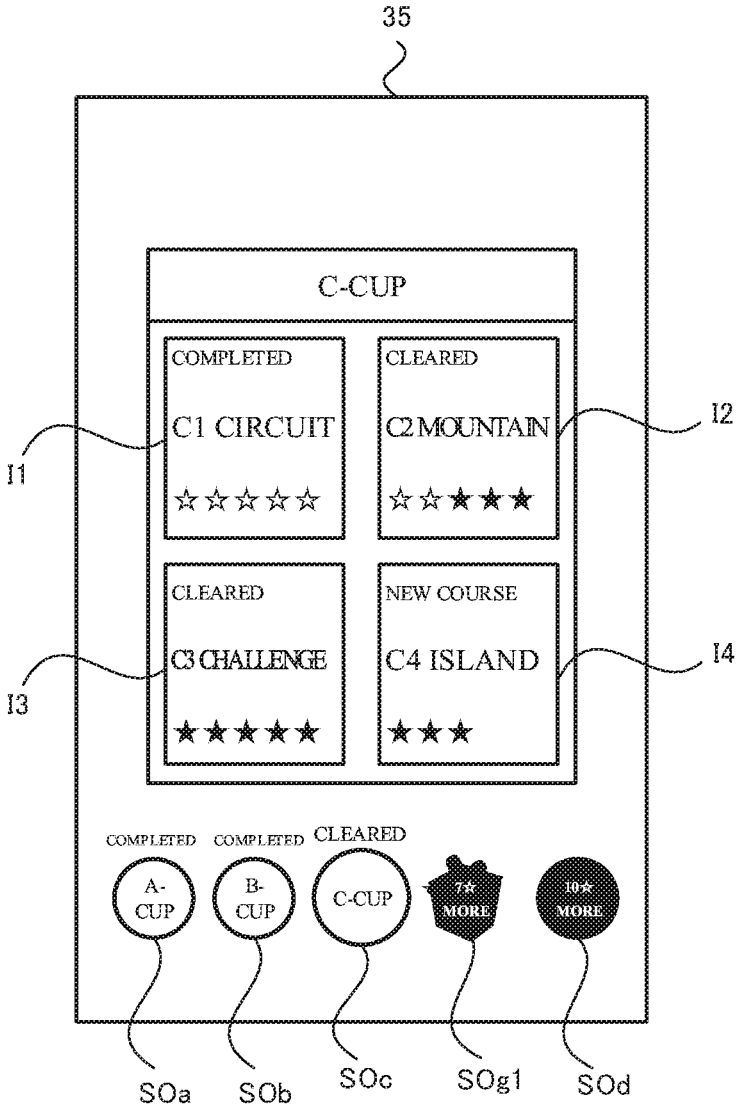
FIG. 6 is a diagram showing a non-limiting example of a game image displayed in a case where a placement object SOc representing a C-cup cup event is selected.
Figure 7:
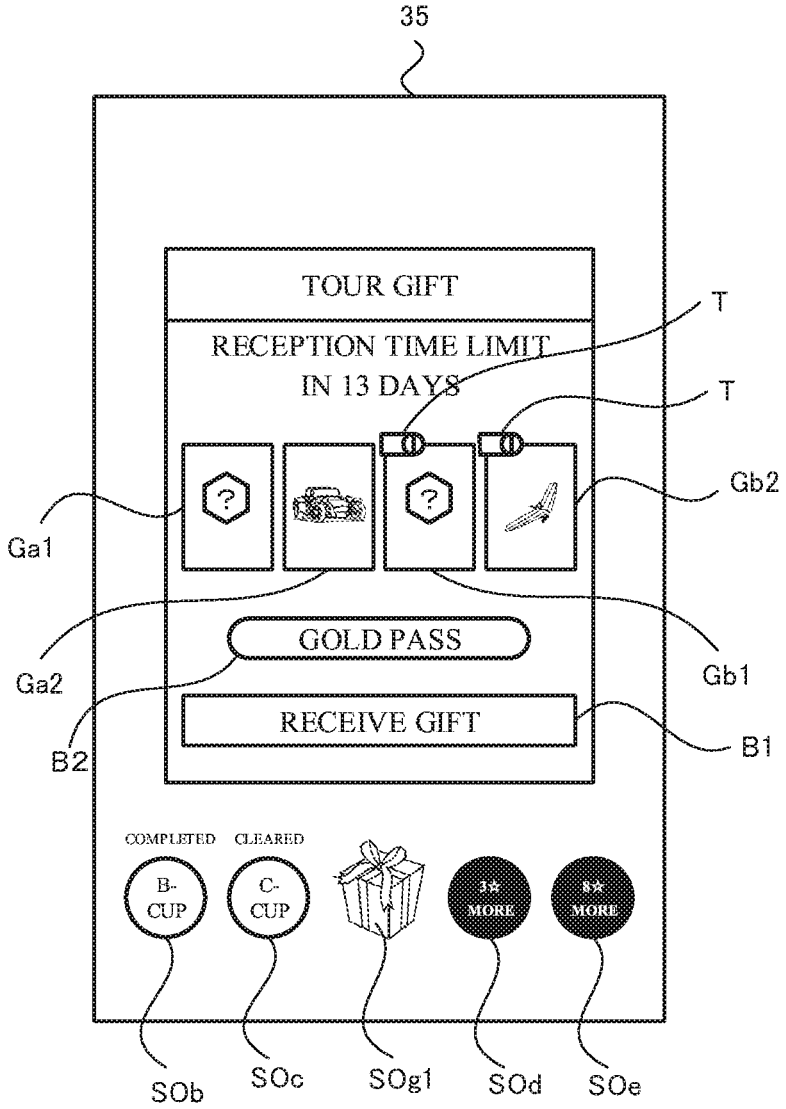
FIG. 7 is a diagram showing a non-limiting example of a game image displayed in a case where a user who does not own a gold pass selects a placement object SO representing a gift event.
Figure 8:
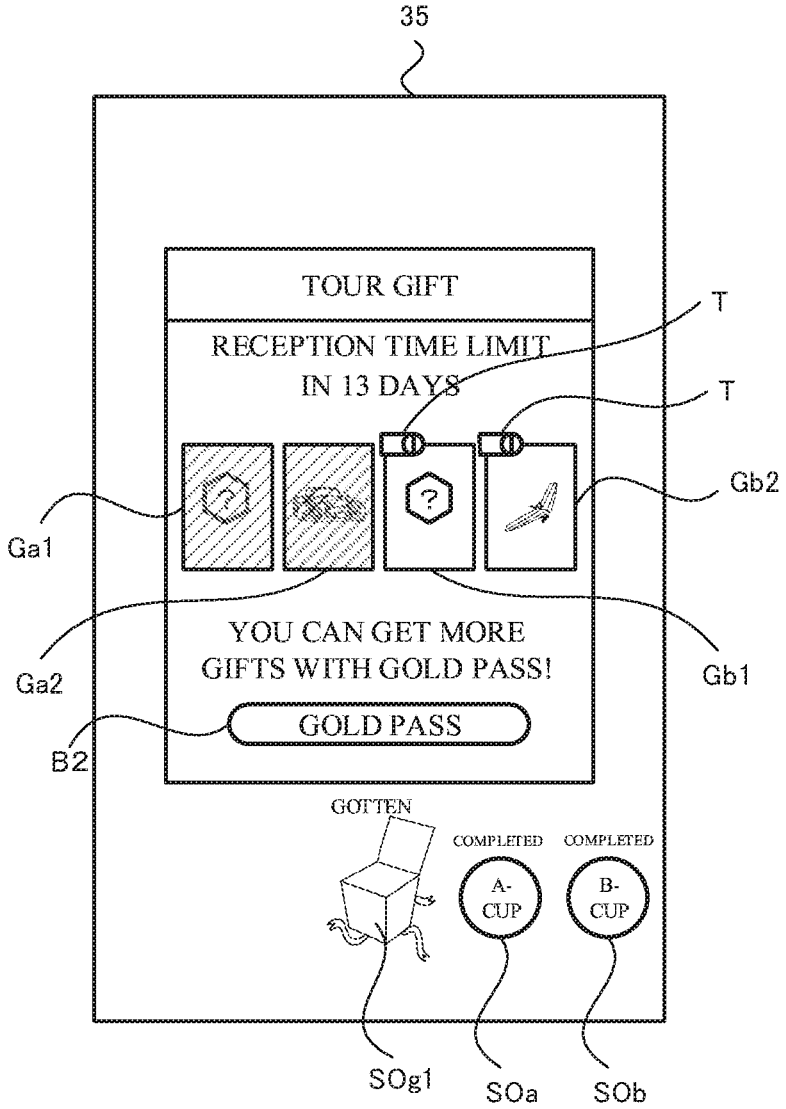
FIG. 8 is a diagram showing a non-limiting example of a game image displayed when the user who does not own the gold pass acquires a gift.
Figure 9:
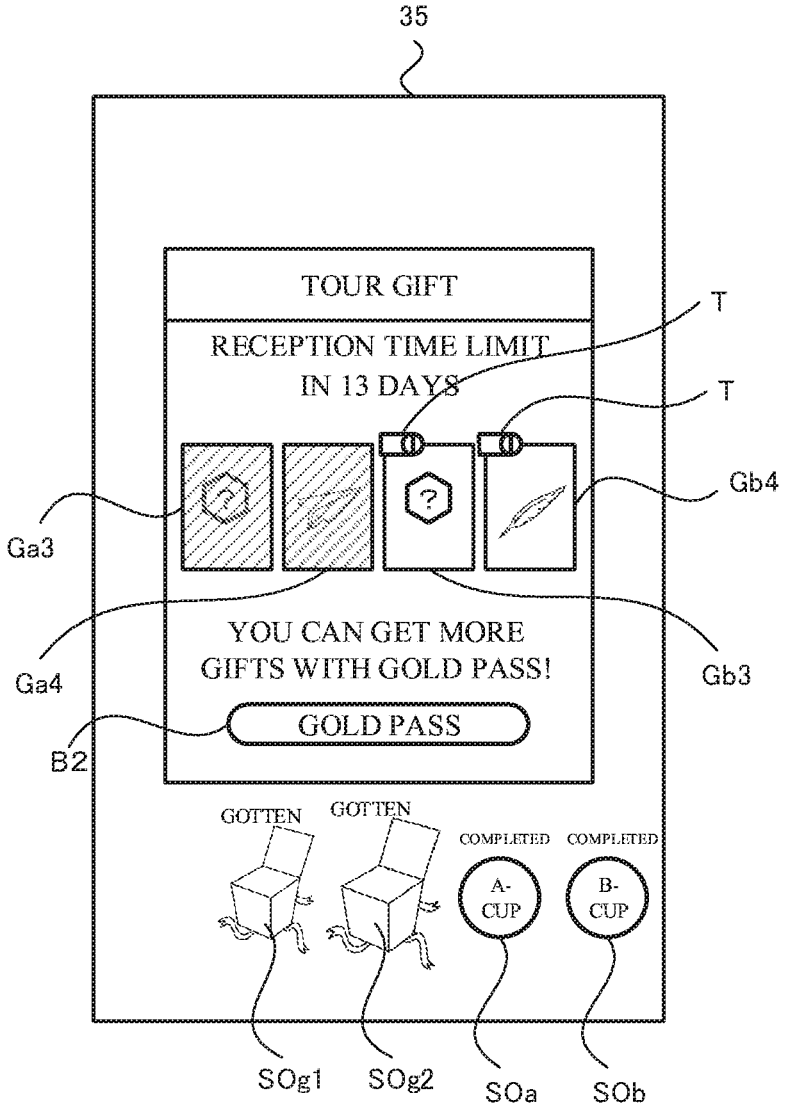
FIG. 9 is a diagram showing a non-limiting example of a game image displayed when the user who does not own the gold pass acquires a new gift again.
Figure 10:
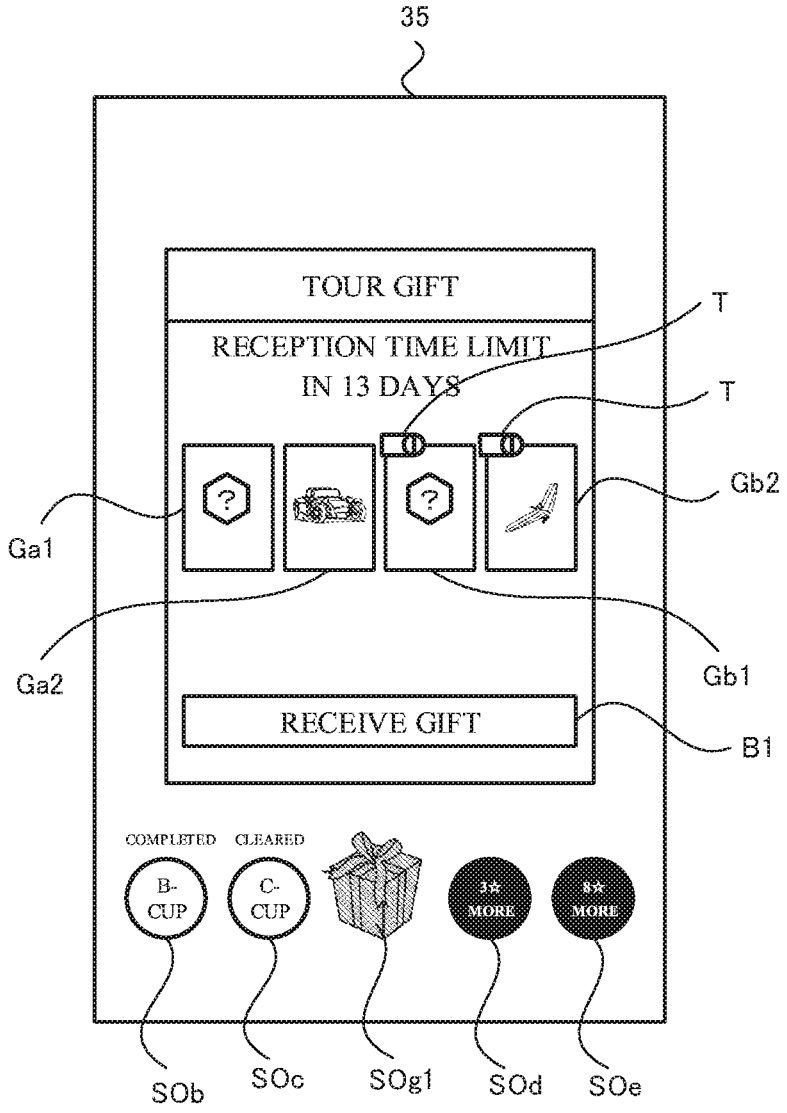
FIG. 10 is a diagram showing a non-limiting example of a game image displayed in a case where a user who owns the gold pass selects a placement object SO representing a gift event.
Figure 11:
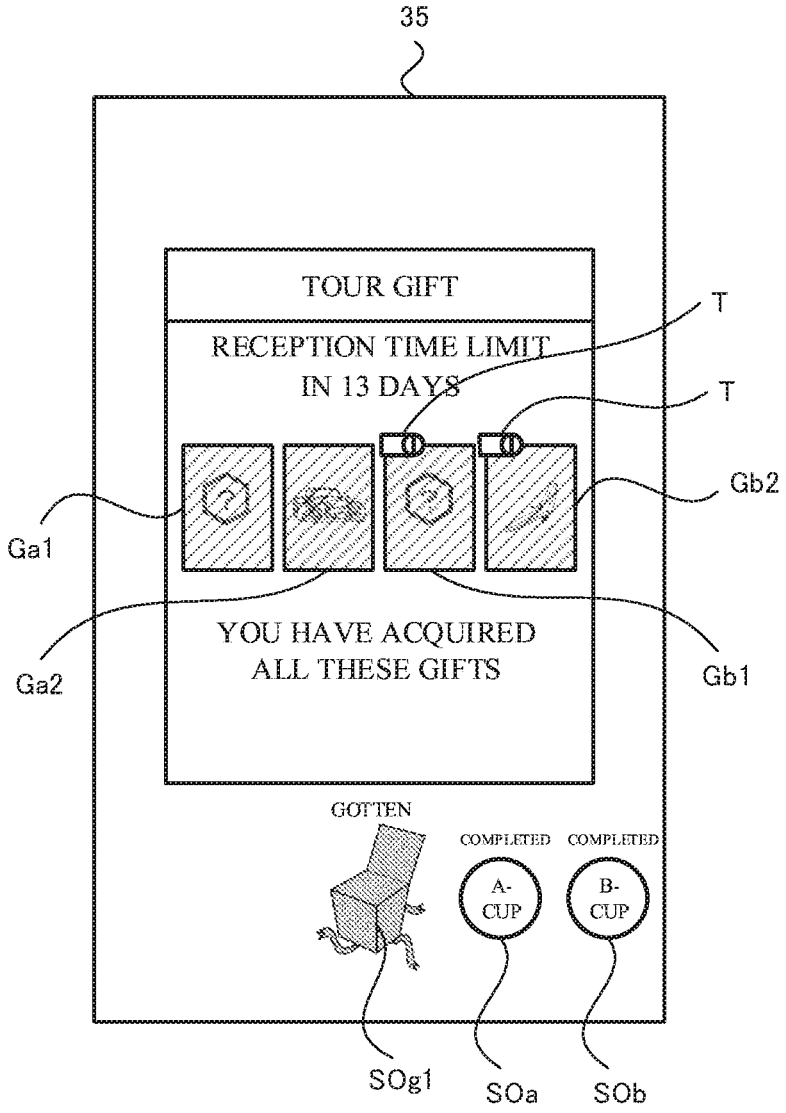
FIG. 11 is a diagram showing a non-limiting example of a game image displayed when the user who owns the gold pass acquires a gift.
Figure 12:
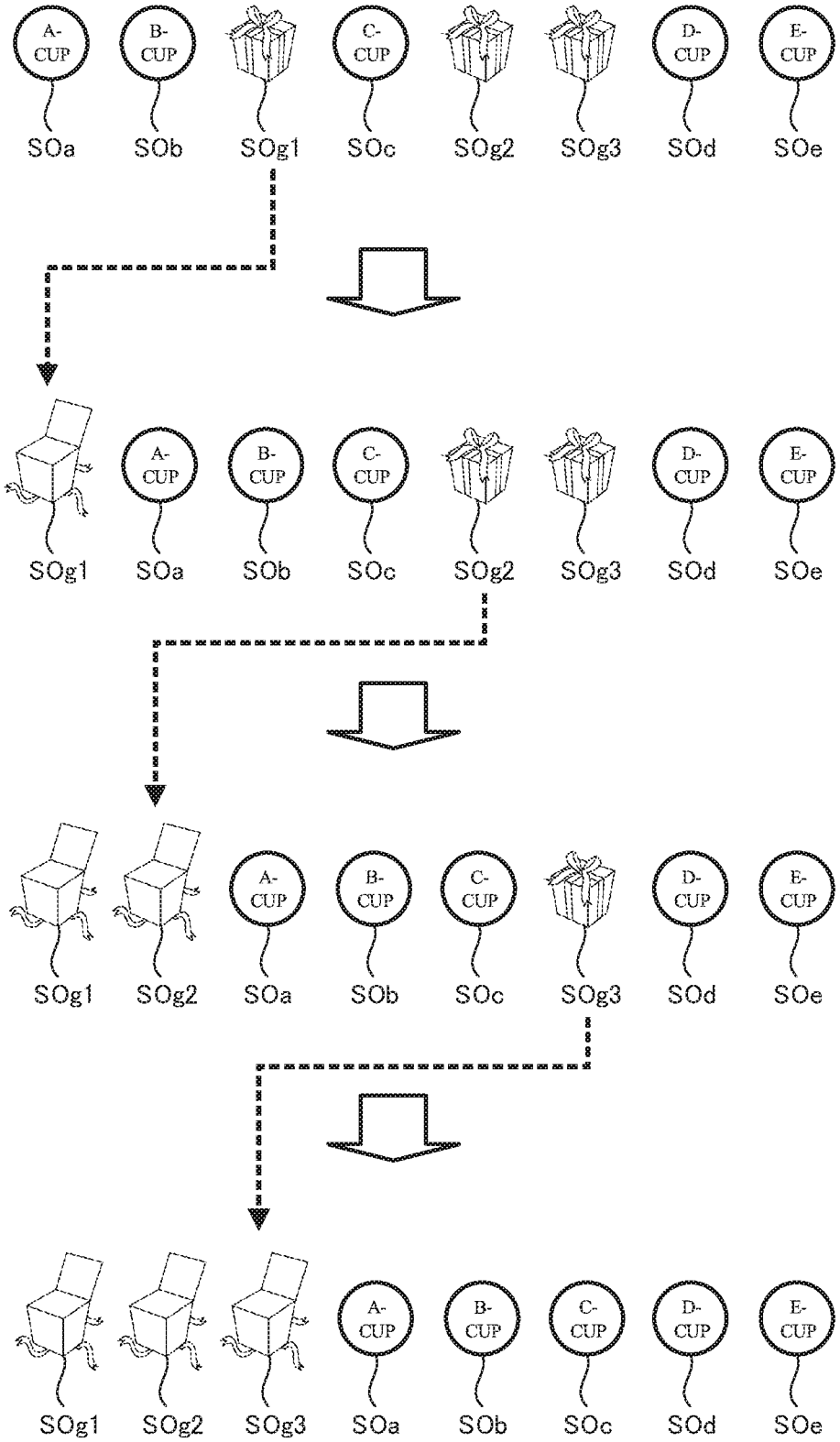
FIG. 12 is a diagram showing non-limiting examples of placement objects SO of which the placement order changes every time a gift event is executed.

Next, with reference to FIGS. 5 to 12, a description is given of a placement object for selecting an event to be played by the user. FIG. 5 is a diagram showing an example of a game image in which placement objects SO representing events that can be played based on the gained points (star points) of the user are displayed. FIG. 6 is a diagram showing an example of a game image displayed in a case where a placement object SOc representing a C-cup cup event is selected. FIG. 7 is a diagram showing an example of a game image displayed in a case where a user who does not own a gold pass selects a placement object SO representing a gift event. FIG. 8 is a diagram showing an example of a game image displayed when the user who does not own the gold pass acquires a gift. FIG. 9 is a diagram showing an example of a game image displayed when the user who does not own the gold pass acquires a new gift again. FIG. 10 is a diagram showing an example of a game image displayed in a case where a user who owns the gold pass selects a placement object SO representing a gift event. FIG. 11 is a diagram showing an example of a game image displayed when the user who owns the gold pass acquires a gift. FIG. 12 is a diagram showing examples of placement objects SO of which the placement order changes every time a gift event is executed.

In FIG. 5, a plurality of placement objects are placed and displayed and include a first object representing a game event of a first type, and a second object representing a game event of a second type. For example, the first object is a plurality of cup objects that are placed and displayed as game images and each represent one of cup events including a plurality of subevents. As an example, in an example of a game image shown in FIG. 5, a cup object SOb representing a B-cup event, a cup object SOc representing a C-cup event, a cup object SOd representing a D-cup event, and a cup object SOe representing an E-cup event are displayed. For example, the second object is at least one gift object that is placed and displayed as a game image and represents a gift event. As an example, in the example of the game image shown in FIG. 5, a gift object SOg1 representing a first gift event is displayed. The plurality of placement objects include a plurality of cup objects and at least one gift object, and as an example, are sequenced side by side in a line and displayed in a lower portion of the screen of the display section 35. Typically, the plurality of placement objects placed side by side in a line are configured to be scrolled in the horizontal direction of the screen in accordance with a user operation, and some of the plurality of placement objects are displayed in the screen.

One of the placement objects can be selected in accordance with a user operation, and an event content represented by the selected placement object (e.g., a placement object placed at the center in the left-right direction of the screen) is displayed at the center of the screen. For example, in the example of FIG. 5, the gift object SOg1 is selected, and a "tour gift" is displayed as the content of the first gift event represented by the gift object SOg1. Specifically, it is indicated that if the first gift event represented by the gift object SOg1 is executed, two gifts Ga1 and Ga2 as non-gold gifts and two gifts Gb1 and Gb2 as gold gifts are gaining targets. Here, the gold gifts Gb1 and Gb2 indicate gifts that can be gained by the user if the user owns a gold pass, and are displayed by giving indicators T for identifying that the gold gifts Gb1 and Gb2 are gold gifts to the gold gifts Gb1 and Gb2. On the other hand, the non-gold gifts Ga1 and Ga2 indicate gifts that can be gained by the user even if the user does not own the gold pass, and are displayed without giving indicators T to the non-gold gifts Ga1 and Ga2.

Due to the satisfaction of a predetermined condition, an event represented by each of the placement objects becomes able to be played and executed. For example, for each of the placement objects, a required accumulated value for gained points (star points) that enables the event to be played and executed is set. The accumulated value of the gained points owned by the user reaches the required accumulated value, whereby the event represented by the placement object becomes able to be played and executed. Each of the placement objects is displayed so that it can be distinguished whether or not the event represented by the placement object can be played and executed. Regarding a placement object representing an event that cannot be played and executed, the number of gained points that are further required is displayed. For example, in the example of FIG. 5, it is indicated that the B-cup event and the C-cup event represented by the cup object SOb and the cup object SOc, respectively, can be played. Then, it is indicated that regarding the gift object SOg1, seven more gained points are required to enable the first gift event to be executed. It is also indicated that regarding the cup object SOd, 10 more gained points are required to enable the D-cup event to be played. It is indicated that regarding the cup object SOe, 15 more gained points are required to enable the E-cup event to be played. Then, the placement objects representing the events that can be played and executed are collectively sequenced, and the placement objects representing the events that cannot be played and executed are collectively sequenced (the placement objects representing the events that can be played and executed are collectively sequenced on the left side in the example of FIG. 5). The placement objects representing the events that cannot be played and executed are sequenced in ascending order or descending order of the number of gained points required to permit the execution of the events (ascending order from left to right in the example of FIG. 5). Gained points correspond to an example of a parameter required to permit the execution of a game event.

As a condition for enabling an event represented by a placement object to be played and executed, another condition may be added in addition to the fact that the accumulated value of the gained points owned by the user reaches the required accumulated value. For example, under the condition that all events represented by a placement object placed on the top side of placement objects as targets in the placement order of the plurality of placement objects are cleared, the events represented by the placement objects as the targets may become able to be played and executed. The condition may differ in accordance with the type of the placement object. As an example, if the placement objects as the targets are cup objects, under the condition that all events represented by cup objects placed on the top side of the cup objects are cleared, the cup events may become able to be played. If the placement objects as the targets are gift objects, the satisfaction of this condition may not be necessary. In this case, even if events represented by cup objects placed on the top side of the gift objects as the targets are not cleared, but if the accumulated value of the gained points owned by the user reaches the required accumulated value, the gift events represented by the gift objects become able to be executed.

As described above, for gained points that enable each event to be played and executed, the number of points that can be gained is set with respect to each subevent included in a tour event. The user repeats the play of the subevent and thereby can acquire gained points in an accumulated manner up to the number of points that can be gained. For example, in a game image shown in FIG. 6, the cup object SOc is selected, and the content of the C-cup event represented by the cup object SOc is displayed. Specifically, it is indicated that the C-cup event represented by the cup object SOc includes four subevents including a C1 circuit I1, a C2 mountain I2, a C3 challenge I3, and a C4 island I4. Then, it is indicated that the C1 circuit I1 is in a completed state where all the number of (five) points that can be gained has already been gained by the user. It is indicated that the C2 mountain I2 is in a cleared state where in the number of (five) points that can be gained, two gained points have already been gained by the user, and three gained points have not yet been gained. It is indicated that the C3 challenge I3 is in a cleared state where all the number of (five) points that can be gained has not yet been gained. Then, it is indicated that the C4 island I4 is in the state where all the number of (three) points that can be gained has not yet been gained, and is a new course (a new event) that has not yet been cleared by the user. As described above, since the C-cup event includes subevents that are not completed, a display image indicating a cleared state is given to the cup object SOc representing the C-cup event. Then, to a cup object representing a cup event where all the subevents are completed (the cup objects SOa and SOb in the example of FIG. 6), a display image indicating a completed state is given. If the user gains gained points by playing a subevent that does not reach the number of points that can be gained among the subevents that thus can be played, the user can acquire the gained points in an accumulated manner. Then, if the accumulated value of the gained points of the user reaches a required accumulated value for a certain event, the display form of a placement object representing the event is changed to a display form in which the event represented by the placement object can be played and executed.

As shown in FIG. 7, if the user selects the gift object SOg1 representing the first gift event that can be executed, it is indicated that the two gifts Ga1 and Ga2 as non-gold gifts and the two gifts Gb1 and Gb2 as gold gifts are gaining targets. Then, a selection button B1 for the user to acquire a gaining target gift in the first gift event is displayed. The user selects the selection button B1, whereby a gift corresponding to a right owned by the user is given to the user. Here, the gold pass is a right that can be owned by the user by paying (charging) an equivalent, and gives the user a right to gain a gold gift in a predetermined valid period. Then, if the user executing the first gift event does not own the gold pass, the user selects the selection button B1, whereby the two gifts Ga1 and Ga2 as non-gold gifts are given to the user. To a user who does not own the gold pass, a selection button B2 for newly owning the gold pass is displayed, thereby notifying the user that the two gifts Gb1 and Gb2 as gold gifts can also be further gained by owning the gold pass. As described above, a gold gift is a gift that can be gained by only a user who owns the gold pass, whereas a non-gold gift is a gift that can be gained by all users. That is, a condition for giving a non-gold gift to the user is that a gift event where the non-gold gift is a gaining target becomes able to be executed. A condition for giving a gold gift to the user is that the user owns the gold pass in addition to the fact that a gift event where the gold gift is a gaining target becomes able to be executed. A non-gold gift corresponds to an example of a first reward, and the giving condition that a gift event becomes able to be executed corresponds to an example of a first giving condition. A gold gift corresponds to an example of a second reward, and the giving condition that the user owns the gold pass corresponds to an example of a second giving condition.

If the user does not own the gold pass, a gift object representing a gift event that can be executed (e.g., the gift object SOg1 shown in FIG. 7) is displayed in a first display form indicating a gold pass non-owned state. A reception time limit may be set for a gift displayed in the gift event, and the reception time limit may be displayed as a content indicating the gift event.

As shown in FIG. 8, in the first gift event that can be executed, if a user operation for selecting the selection button B1 is performed to acquire a gaining target gift, a gift that can be gained by the user is given to the user. For example, in the example of FIG. 8, since the user executing the first gift event does not own the gold pass, the two gifts Ga1 and Ga2 as non-gold gifts change to display forms (e.g., gray-out) indicating that the two gifts Ga1 and Ga2 are given to the user. Since the user does not own a right (the gold pass) to gain a gold gift, the two gifts Gb1 and Gb2 as gold gifts are displayed by maintaining their original display forms. Then, the selection button B2 for newly owning the gold pass is continuously displayed to the user who does not own the gold pass, thereby notifying the user of information indicating that the two gifts Gb1 and Gb2 as gold gifts can be further gained by owning the gold pass.

If the user performs the operation of gaining a gift, the display form of a gift object representing a gift event for gaining the gift is changed, and the position of the gift object in the sequential order of the placement objects is also changed. For example, as shown in FIG. 8, if the user performs the operation of gaining a gift in the first gift event, the display form of the gift object SOg1 representing the first gift event changes to an image indicating that the gift is already gained and is in an opened state. Then, the sequential position of the gift object SOg1 is changed to a position (e.g., the left side) before the cup object SOa placed at the top (e.g., the left end) in the sequential order of the placement objects. Alternatively, the sequential position of the gift object SOg1 may be changed to the end in the sequential order of the placement objects. In this case, the sequential position may be changed to a position (e.g., the right side) after a cup object placed at the end (e.g., the right end) in the sequential order.

If a second gift event is executed, and the operation of gaining a gift in the gift event is performed, the display form of a gift object representing the gift event for gaining the gift is also changed, and the position of the gift object in the sequential order of the placement objects is also changed. For example, as shown in FIG. 9, after the user gains a gift in the first gift event, and if the user performs the operation of gaining a gift in a second gift event, the display form of a gift object SOg2 representing the second gift event changes to an image indicating that the gift is already gained and is in an opened state. Then, the sequential position of the gift object SOg2 is changed to a position adjacent to the gift object SOg1 of which the position in the sequential order is changed earlier. For example, if the gift object SOg1 is changed to a position (e.g., the left side) before the cup object SOa placed at the top (e.g., the left end) in the sequential order of the placement objects, the sequential position of the gift object SOg2 is changed to a position between the gift object SOg1 and the cup object SOa. In the above example of the sequential position, a gift object regarding which a gift is gained earlier is sequenced on the top side (e.g., the left side) in the sequential order of the placement objects. Alternatively, a gift object regarding which a gift is gained later may be sequenced on the top side in the sequential order of the placement objects. In this case, the sequential position of the gift object SOg2 is changed to a position (e.g., the left side) before the gift object SOg1.

As shown in FIG. 10, even if the user owns the gold pass, and the user selects the gift object SOg1 representing the first gift event that can be executed, it is indicated that the two gifts Ga1 and Ga2 as non-gold gifts and the two gifts Gb1 and Gb2 as gold gifts are gaining targets. Then, the selection button B1 for the user to acquire a gaining target gift in the first gift event is displayed. The user selects the selection button B1, whereby a gift corresponding to a right owned by the user is given to the user. Then, if the user executing the first gift event owns the gold pass, the user selects the selection button B1, whereby all the gifts, namely the two gifts Ga1 and Ga2 as non-gold gifts and the two gifts Gb1 and Gb2 as gold gifts, are given to the user. To a user who owns the gold pass, the selection button B2 for newly owning the gold pass is not displayed.

If the user owns the gold pass, a gift object representing a gift event that can be executed (e.g., the gift object SOg1 shown in FIG. 10) is displayed in a second display form indicating a gold pass owned state. Here, the second display form of the gift object only needs to be able to be visually distinguished from the first display form of the gift object indicating the gold pass non-owned state, and at least one of the color, the size, the pattern, the design, the motion, and the like of the gift object may be different. Similarly to the example shown in FIG. 7, a reception time limit may be set for a gift displayed in the gift event, and the reception time limit may be displayed as a content indicating the gift event.

As shown in FIG. 11, in the first gift event that can be executed, if a user operation for selecting the selection button B1 is performed to acquire a gaining target gift, a gift that can be gained by the user is given to the user. For example, in the example of FIG. 11, since the user executing the first gift event owns the gold pass, all the gifts, namely the two gifts Ga1 and Ga2 as non-gold gifts and the two gifts Gb1 and Gb2 as gold gifts, change to display forms (e.g., gray-out) indicating that all the gifts are given to the user. Then, the user who owns the gold pass is notified of information indicating that all the gifts as gaining targets in the first gift event are already acquired due to the owning of the gold pass.

Also if the user who owns the gold pass performs the operation of gaining a gift, the display form of a gift object representing a gift event for gaining the gift is changed, and the position of the gift object in the sequential order of the placement objects is also changed. For example, as shown in FIG. 11, if the user who owns the gold pass performs the operation of gaining a gift in the first gift event, the display form of the gift object SOg1 representing the first gift event changes to an image indicating that the gift is already gained and is in the opened state. Then, the sequential position of the gift object SOg1 is changed to a position (e.g., the left side) before the cup object SOa placed at the top (e.g., the left end) in the sequential order of the placement objects. Alternatively, the sequential position of the gift object SOg1 may also be changed by the operation of the user who owns the gold pass to the end in the sequential order of the placement objects. In this case, the sequential position may be changed to a position (e.g., the right side) after a cup object placed at the end (e.g., the right end) in the sequential order.

Next, with reference to FIG. 12, a description is given of a form in which the sequential order of the plurality of placement objects is changed. As described above, the plurality of placement objects include a plurality of cup objects and at least one gift object, and as an example, are sequenced side by side in a line, and some of the plurality of placement objects are displayed on the screen of the display section 35. In the example shown in FIG. 12, the plurality of placement objects include five cup objects SOa to SOe and three gift objects SOg1 to SOg3. Then, in an initial state (a state shown in the first row in FIG. 12), the cup object SOa, the cup object SOb, the gift object SOg1, the cup object SOc, the gift object SOg2, the gift object SOg3, the cup object SOd, and the cup object SOe are sequenced in this order from the left end corresponding to the top of the sequential order. As described above, the sequential order of these placement objects is ascending order of the number of gained points required for play and execution from the top of the sequential order.

In such an initial state, if the first gift event represented by the gift object SOg1 placed third from the top of the sequential order is executed, and a gift that can be gained in the first gift event is gained, the gift object SOg1 is changed to a position before the cup object SOa placed at the top of the sequential order (a state shown in the second row in FIG. 12). Then, the space at the portion where the gift object SOg1 has been placed before the placement order is changed is closed by placement objects adjacent to this portion (the cup object SOb and/or the cup object SOc), thereby aligning the placement objects.

Next, in the above initial state, if the second gift event represented by the gift object SOg2 placed fifth from the top of the sequential order is executed, and a gift that can be gained in the second gift event is gained, the gift object SOg2 is changed to a position between the gift object SOg1 in the opened state and the cup object SOa placed at the top of the sequential order (a state shown in the third row in FIG. 12). Then, the space at the portion where the gift object SOg2 has been placed before the placement order is changed is closed by placement objects adjacent to this portion (the cup object SOc and/or the gift object SOg3), thereby aligning the placement objects.

Then, in the initial state, if a third gift event represented by the gift object SOg3 placed sixth from the top of the sequential order is executed, and a gift that can be gained in the third gift event is gained, the gift object SOg3 is changed to a position between the gift object SOg2 in the opened state and the cup object SOa (a state shown in the fourth row in FIG. 12). Then, the space at the portion where the gift object SOg3 has been placed before the placement order is changed is closed by placement objects adjacent to this portion (the cup object SOc and/or the cup object SOd), thereby aligning the placement objects.

As described above, if a gift in a gift event represented by a gift object is gained, the sequential position of the gift object is sequentially changed to the top side in the sequential order of the plurality of placement objects. Such a movement of the sequential position of the gift object is made regardless of whether the user owns the gold pass. Thus, even if the user does not own the gold pass, i.e., even if a gift that has not been gained is left in a gift event, the sequential position of a gift object representing the gift event is changed. This makes it easier to select a placement object representing another event than in a case where the gift object regarding which the gift that has not been gained is left continues to be displayed at the same sequential position. Thus, it is possible to improve the convenience of selection of a placement object. As described above, even in the state where a subevent is cleared, the subevent can be repeatedly played in the exemplary embodiment. Thus, by repeating the play, it is possible to further accumulate gained points in the subevent. Thus, to perform such repeated play, it is necessary to select an already cleared cup object many times. Thus, in such a play environment, it is possible that the effect of changing the sequential position of the above gift object in the sequential order becomes greater.

After a user who does not own the gold pass gains a non-gold gift in a gift event, and if the user acquires a right to gain a gold gift, a gold gift that has not been gained by the user before the acquisition of the right may automatically change to a user-owned state, or may change to the user-owned state as needed in accordance with a user operation. In the first case, using as a trigger the fact that the user newly acquires the right to gain a gold gift, representation indicating that the user newly additionally acquires all gold gifts that have not yet been gained before the acquisition of the right may be performed, and the gold gifts may be changed to user-owned states. In the second case, the user may select a gift object representing a gift event regarding which a gold gift remains in the state where the gold gift has not yet been gained, and in accordance with the fact that the user performs the operation of further acquiring the gold gift, the gold gift may be changed to a user-owned state.

In the above exemplary embodiment, an example has been used where the plurality of placement objects are sequenced on a straight line extending in a left-right direction on the display screen and displayed so that the plurality of placement objects can be scrolled in the left-right direction. Alternatively, another arrangement form may be employed. As a first example, the plurality of placement objects may be sequenced on a straight line extending in another direction (e.g., an up-down direction) on the display screen and displayed so that the plurality of placement objects can be scrolled in this direction. As a second example, the plurality of placement objects may be sequenced on a straight line bent at least one point (e.g., L-shaped or stair-like) and displayed so that the plurality of placement objects can be scrolled along the bent straight line. As a third example, the plurality of placement objects may be sequenced on a path having a branch at least one point (e.g., a path on a map where a branch is set or a fishbone-like path) and displayed so that the plurality of placement objects can be scrolled in a direction corresponding to a user operation. As a fourth example, the plurality of placement objects may be sequenced on a curve on the display screen and displayed so that the plurality of placement objects can be scrolled along the curve. As a fifth example, the plurality of placement objects may be sequenced on a three-dimensional path (including a straight line path, a bent straight line path, and a curved path) in a virtual game space including the depth direction of the display screen and displayed so that the plurality of placement objects can be scrolled along this path.

In the above exemplary embodiment, an example has been used where if a gift in a gift event represented by a gift object is gained, the sequential position of the gift object is changed to the top side or the end side in the sequential order of the plurality of placement objects. Alternatively, as an example, a gift object of which the sequential position in the sequential order is changed may be displayed when the sequential position is changed. Yet alternatively, as another example, a gift object of which the sequential position in the sequential order is changed may be controlled to be in the state where the gift object is not displayed at least immediately after the sequential position is changed. In this case, using the movement of the gift object as a trigger, the position of the display range of the plurality of placement objects may be controlled so that the gift object is placed outside the display range.

If a gift object representing a gift event in which all gifts are already gained is selected, the content of the gift event may be allowed to be confirmed. This enables the user to confirm the history of gifts gained in the past (e.g., confirm gift events regarding which gifts have been gained). If such effects are not desired, a gift object representing a gift event in which all gifts are already gained may be erased when all the gifts are already gained.

Figure 13:
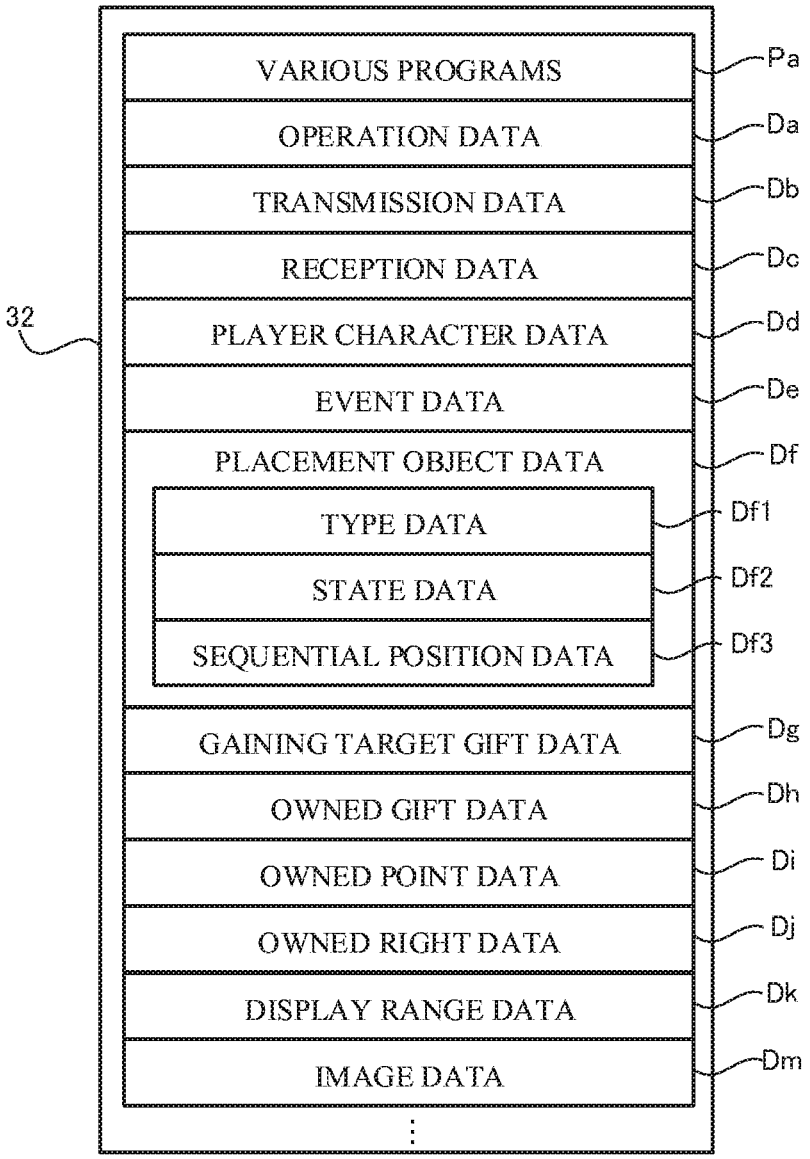
FIG. 13 is a diagram showing non-limiting examples of main data and programs stored in a storage section 32 of the information processing apparatus 3.

Next, the details of processing performed by each information processing apparatus 3 are described. First, with reference to FIG. 13, a description is given of main data used in the processing performed by the information processing apparatus 3. FIG. 13 is a diagram showing examples of main data and programs stored in the storage section 32 of the information processing apparatus 3.

As shown in FIG. 13, the following are stored in the data storage area of the storage section 32: operation data Da; transmission data Db; reception data Dc; player character data Dd; event data De; placement object data Df; gaining target gift data Dg; owned gift data Dh; owned point data Di; owned right data Dj; display range data Dk; image data Dm; and the like. The storage section 32 stores, as well as the data included in the information shown in FIG. 13, data and the like necessary for the processing, such as data used in an application to be executed. In the program storage area of the storage section 32, various programs Pa included in a communication program and an information processing program (a game program) are stored.

The operation data Da is data indicating operation information of the operation performed on the information processing apparatus 3 by the user. For example, operation data indicating the operation performed on the input section 34 including the touch panel is acquired per time unit that the information processing apparatus 3 performs processing (e.g., every 1/60 second), and the operation data is stored and updated in the operation data Da in accordance with the acquisition.

The transmission data Db is data registered as data to be transmitted to the server 200. The reception data Dc is data received from the server 200.

The player character data Dd is data related to the player character PO that performs an action in accordance with a user operation in a game played in a subevent or the like. For example, the player character data Dd also includes data indicating the position, the velocity, the orientation, the number of laps, the ranking, and the like of the player character PO in the game.

The event data De is data indicating the content of each set event, the settings of states such as a cleared state, a completed state, and a gotten state, a required number of accumulated points, and the like. The event data De is set with respect to each subevent, each cup event including the subevent, and each gift event and includes data indicating the number of gained points that can be gained in each subevent, the number of already gained points in each subevent, and the setting of a gift that has not yet been gained or has already been gained in each gift event.

The placement object data Df is data indicating the content and the state of each placement object and includes type data Df1, state data Df2, sequential position data Df3, and the like. The type data Df1 is data indicating the type of each placement object (e.g., a distinction between a cup object and a gift object, and the content, the name, and the like of each object). The state data Df2 is data indicating the state of each placement object (whether or not an event represented by the placement object can be played and executed, the number of accumulated points further required to enable the event to be played and executed, whether or not the placement object is opened or not opened, and states such as a cleared state, a completed state, and a gotten state). The sequential position data Df3 is data indicating the sequential position of each placement object.

The gaining target gift data Dg is data indicating a gaining target gift set for each gift event and the type of the gaining target gift (e.g., whether or not the gaining target gift is a gold gift).

The owned gift data Dh is data indicating a gift owned by the user. The owned point data Di is data indicating gained points owned by the user. The owned right data Dj is data indicating a right (a gold pass) owned by the user.

The display range data Dk is data indicating the display range of a plurality of sequenced placement objects.

The image data Dm is data for displaying a game image (e.g., an image of the player character PO, an image of the enemy object EO, an image of another virtual object, a field image of a course or the like, a background image, a placement object image, an image indicating an event content, a user interface image, or the like) on the display section 35 of the information processing apparatus 3 when a game is performed.

Figure 14:
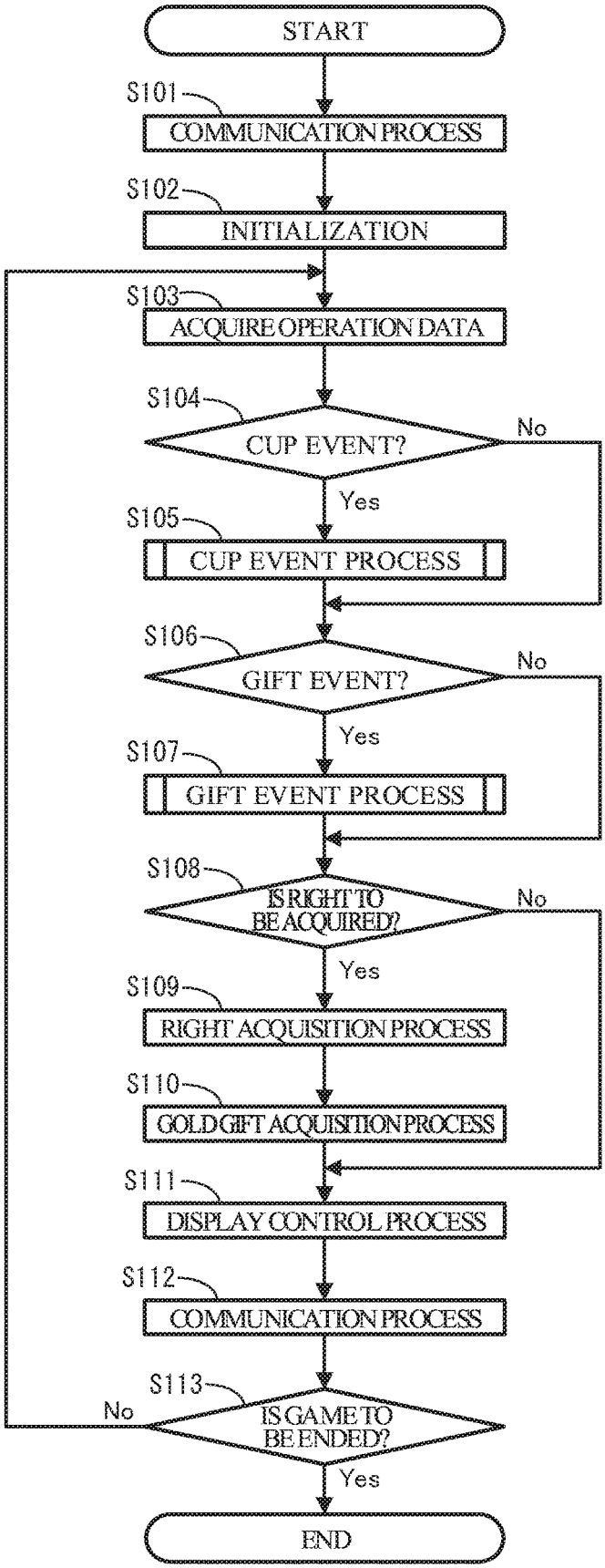
FIG. 14 is a flow chart showing a non-limiting example of processing executed by the information processing apparatus 3.
Figure 15:
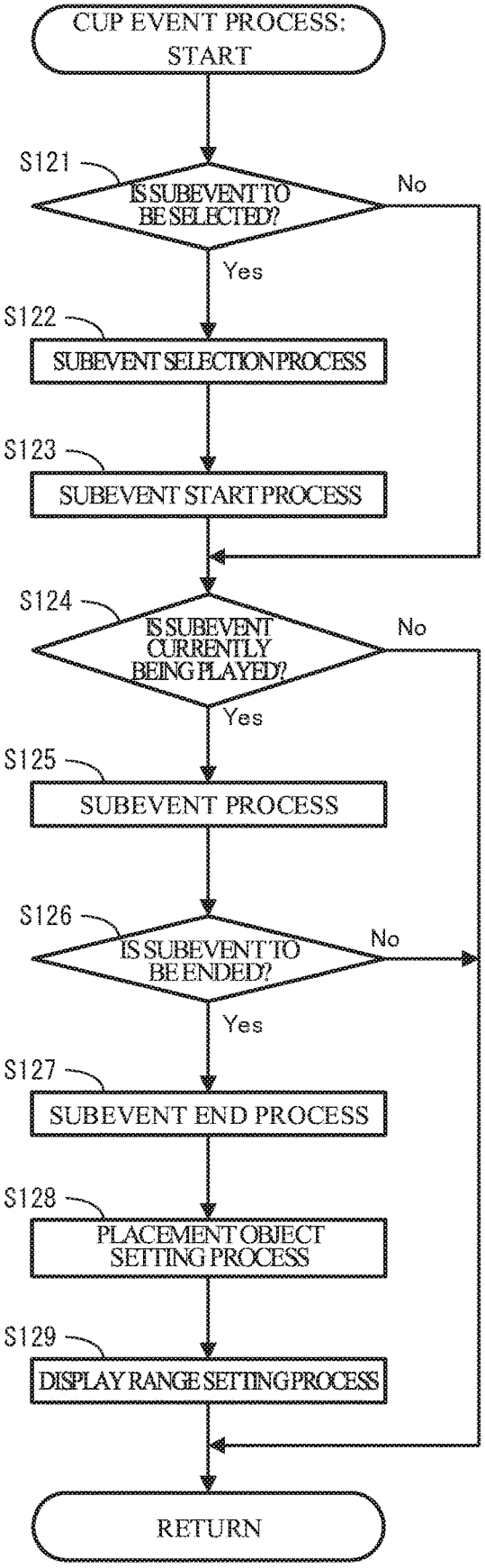
FIG. 15 is a subroutine showing a non-limiting detailed example of a cup event process in step S105 in FIG. 14.
Figure 16:
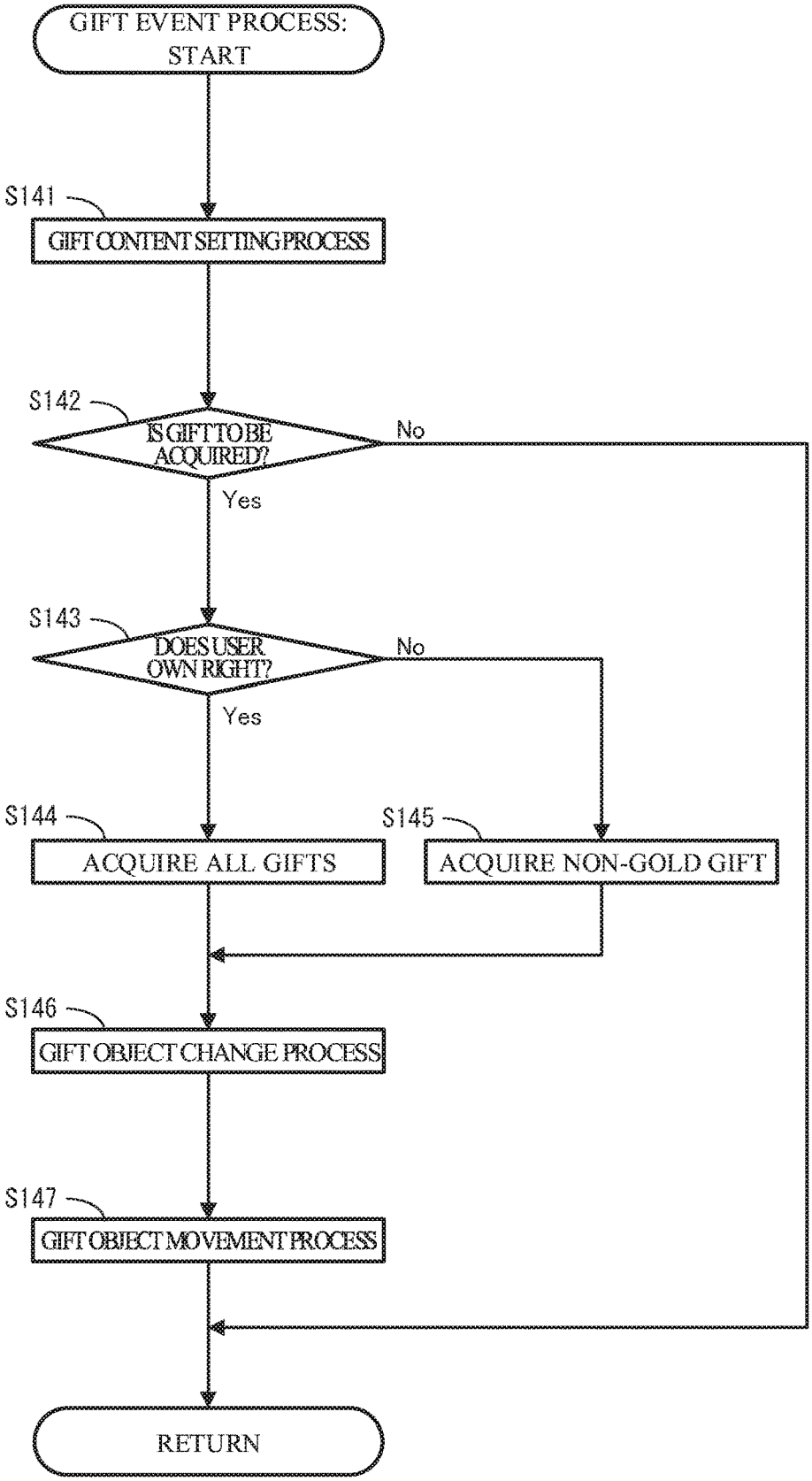
FIG. 16 is a subroutine showing a non-limiting detailed example of a gift event process in step S107 in FIG. 14.

Next, with reference to FIGS. 14 to 16, a description is given of the details of the processing performed by each information processing apparatus 3. FIG. 14 is a flow chart showing an example of the processing executed by the information processing apparatus 3. FIG. 15 is a subroutine showing a detailed example of a cup event process in step S105 in FIG. 14. FIG. 16 is a subroutine showing a detailed example of a gift event process in step S107 in FIG. 14. Here, in the flow charts shown in FIGS. 14 to 16, a description is given mainly of, in the processing performed by the information processing system 1, as an example, game processing related to the process of playing and executing an event represented by a selected placement object. The detailed descriptions of other processes not directly related to these processes are omitted. In FIGS. 14 and 16, all of the steps performed by the control section 31 are abbreviated as "S".

In the exemplary embodiment, a series of processes shown in FIGS. 14 to 16 is performed by the control section 31 (the CPU) executing the communication program and the game program stored in the program storage section 33. The processing shown in FIGS. 14 to 16 may be started at any timing. At this time, a part or all of the game program is loaded into the storage section 32 at an appropriately timing and executed by the control section 31. Consequently, the series of processes shown in FIGS. 14 to 16 is started. The communication program and the game program are stored in advance in the program storage section 33. Alternatively, in another exemplary embodiment, the communication program and the game program may be acquired from a storage medium attachable to and detachable from the information processing apparatus 3 and stored in the storage section 32, or may be acquired from another apparatus via a network such as the Internet and stored in the storage section 32.

The processes of all the steps in the flow charts shown in FIGS. 14 to 16 are merely illustrative. Thus, the processing order of the steps may be changed, or another process may be performed in addition to, and/or instead of, the processes of all the steps, so long as similar results are obtained. In the exemplary embodiment, descriptions are given on the assumption that the control section 31 performs the processes of all the steps in the flow charts. Alternatively, a processor or a dedicated circuit other than the CPU of the control section 31 may perform the processes of some or all of the steps in the flow charts.

In FIG. 14, the control section 31 performs a communication process (step S101), and the processing proceeds to the next step. For example, the control section 31 transmits transmission data (e.g., data for authenticating the user (as an example, data indicating a user ID)) stored in the transmission data Db to the server 200 via the network 100. The control section 31 receives data from the server 200 via the network 100 and updates the reception data Dc using the received data. As an example, in a case where the information processing apparatus 3 performs a game with another information processing apparatus 3 or performs a game alone, in the above step S101, the control section 31 appropriately transmits and receives data for advancing the game to and from the server 200.

Next, the control section 31 performs initialization (step S102), and the processing proceeds to the next step. For example, the control section 31 initializes parameters used in the subsequent processing. Based on a content such as a player character currently owned by the user, the control section 31 initializes the player character data Dd. In the above step S101, the control section 31 receives, from the server 200, at least parts of data owned by the user (e.g., data regarding the accumulated value of gained points, a right owned by the user, virtual currency, in-game coins, a group of characters, an item, an empirical value, a play level, and the like) and data regarding the content of each event. Then, based on the data received from the server 200 and the data stored in the information processing apparatus 3, the control section 31 initializes the parameters. For example, based on the data received from the server 200, the control section 31 initializes the type, the state, the sequential position, and the like of each placement object and updates the placement object data Df based on this setting state.

Next, the control section 31 acquires operation data from the input section 34 and updates the operation data Da (step S103), and the processing proceeds to the next step.

Next, the control section 31 determines whether or not the process of selecting and playing a cup event is to be performed (step S104). For example, based on the operation data acquired in the above step S103, if a cup object is selected among a plurality of placement objects (e.g., a user operation for placing the cup object at the center in the left-right direction of the screen is performed), or if a subevent is being played, the determination is affirmative in the above step S104. Then, if the process of selecting and playing a cup event is to be performed, the processing proceeds to step S105. If, on the other hand, the process of selecting and playing a cup event is not to be performed, the processing proceeds to step S106.

In step S105, the control section 31 performs a cup event process, and the processing proceeds to step S106. With reference to FIG. 15, a description is given below of the cup event process performed in the above step S105.

In FIG. 15, the control section 31 determines whether or not the process of selecting a subevent is to be performed (step S121). For example, based on the operation data acquired in the above step S103, if the operation of viewing the content of a cup event represented by the currently selected cup object or the operation of selecting a subevent to be played from a plurality of subevents is performed, the determination is affirmative in the above step S121. Then, if the process of selecting a subevent is to be performed, the processing proceeds to step S122. If, on the other hand, the process of selecting a subevent is not to be performed, the processing proceeds to step S124.

In step S122, the control section 31 performs the process of selecting a subevent, and the processing proceeds to the next step. For example, based on the event data De, the control section 31 generates an image indicating the content of the currently selected cup event (e.g., an image indicating a plurality of subevents included in the cup event; see FIG. 6) and performs control to display the image on the display section 35 in the process of step S111 described below, thereby urging the user to perform the operation of selecting a subevent from the subevents. Here, with respect to each subevent to be displayed on the display section 35, the control section 31 gives an image indicating the number of points that can be gained, the number of already gained points, the situation (a distinction between a cleared state, a completed state, and a new course) to the subevent, thereby generating an image. In the process of the above step S122, if the currently selected cup event is in the state where the currently selected cup event cannot be played, the control section 31 may generate an image indicating that the subevents included in the cup event cannot be selected (e.g., an image in which the subevents are grayed out), and perform control to display the image on the display section 35.

Next, in accordance with a user operation, the control section 31 performs the process of starting the selected subevent (step S123), and the processing proceeds to step S124. For example, if the operation data acquired in the above step S103 indicates the operation of selecting any of the subevents included in the currently selected cup event, the control section 31 performs the process of starting the selected subevent.

In step S124, the control section 31 determines whether or not the subevent is currently being played. Then, if the subevent is current being played, the processing proceeds to step S125. If, on the other hand, the subevent is not current being played, the processing of this subroutine ends.

In step S125, in accordance with a user operation, the control section 31 performs a subevent process, and the processing proceeds to the next step. For example, with reference to the event data De, in accordance with a user operation, the control section 31 advances the representation of the currently started subevent and performs control to display an image related to the representation on the display section 35 in the process of step S111 described below. As an example, based on the operation data acquired in the above step S103, the control section 31 sets the movement action of the player character PO in the virtual game space based on the coordinates of a touch position on the touch panel. Then, based on the set movement action, the control section 31 sets the position and the orientation of the player character PO and updates the player character data Dd, thereby setting representation that the player character PO performs an action. Based on a predetermined algorithm, the control section 31 also performs representation that the enemy object EO performs an action in the virtual game space.

Next, the control section 31 determines whether or not the subevent is to be ended (step S126). Examples of a condition for ending the subevent include the satisfaction of a condition for ending the subevent, the fact that the user performs the operation of ending the subevent, and the like. Then, if the subevent is to be ended, the processing proceeds to step S127. If, on the other hand, the subevent is not to be ended, the processing of this subroutine ends.

In step S127, the control section 31 performs a subevent end process, and the processing proceeds to the next step. For example, based on the result of the subevent that is to be ended according to the determination in the above step S126, the control section 31 calculates gained points to be given to the user, and based on the calculation result, updates the owned point data Di and the event data De related to the subevent. Using the result of the subevent that is to be ended according to the determination in the above step S126 and the number of points that can be gained and the number of already gained points in the subevent, the control section 31 sets the situation of the subevent (a distinction between a cleared state, a completed state, and a new course) and updates the event data De related to the subevent.

Next, the control section 31 performs a placement object setting process (step S128), and the processing proceeds to the next step. For example, the control section 31 sets the cup object representing the cup event including the subevent of which the play is ended, and a placement object displayed after the cup object in the placement order of the placement objects. Specifically, if the situation of the subevent of which the play is ended changes (changes to a cleared state or changes to a completed state), based on the situation of the change, the control section 31 updates the state data Df2 regarding the cup object representing the cup event including the subevent. Based on the number of gained points owned by the user and the change in the situation of the cup event including the ended subevent, the control section 31 changes an event that cannot be played and executed to the state where the event can be played and executed. As an example, in a case where a cup object adjacent to the end side of the cup object representing the currently played cup event in the sequential order of the placement objects satisfies a required number of accumulated gained points, and the cup event including the subevent of which the play is ended is in a cleared or completed state, and if a cup event represented by the adjacent cup object is in the state where the cup event cannot be played, the cup event represented by the adjacent cup object is changed to the state where the cup event represented by the adjacent cup object can be played, thereby updating the event data De and the placement object data Df. As another example, in a case where a gift object placed on the end side of the cup object representing the currently played cup event in the sequential order of the placement objects satisfies a required number of accumulated gained points, and if a gift event represented by the gift object is in the state where the gift event cannot be executed, the gift event represented by the gift object is changed to the state where the gift event can be executed, thereby updating the event data De and the placement object data Df.

Alternatively, gained points may be able to be gained in representation different from the play of a subevent. In this case, in accordance with the addition of points to the number of gained points owned by the user at a timing other than a process after the subevent is ended, the placement object setting process in the above step S128 may be performed. For example, points may be added to the gained points using a particular item owned by the user, or gained points may be acquired as one of gifts in a gift event. In this case, when points are added to the number of gained points, a process similar to the placement object setting process in the above step S128 may be performed, whereby an event that cannot be played and executed may change to an event that can be played and executed.

Next, the control section 31 performs a display range setting process (step S129), and the processing of this subroutine ends. For example, the control section 31 sets a display range where the plurality of placement objects are to be displayed on the display section 35, so that the cup object representing the cup event including the subevent of which the play is ended is in a selected state (e.g., the state where the cup object is placed at the center in the left-right direction of the screen). Then, the control section 31 updates the display range data Dk using the display range. Consequently, in the state after a subevent (a cup event including a plurality of subevents) is played, the plurality of placement objects are displayed in a default display range where a cup object representing the subevent (the cup event including the plurality of subevents) is in a selected state. In the above default display range of the plurality of placement objects, the cup object may not be in the selected state, and the cup object may be at least displayed on the display section 35.

Referring back to FIG. 14, in step S106, the control section 31 determines whether or not the process of selecting and executing a gift event is to be performed. For example, based on the operation data acquired in the above step S103, if a gift object is selected among the plurality of placement objects (e.g., a user operation for placing the gift object at the center in the left-right direction of the screen is performed), the determination is affirmative in the above step S106. Then, if the process of selecting and executing a gift event is to be performed, the processing proceeds to step S107. If, on the other hand, the process of selecting and executing a gift event is not to be performed, the processing proceeds to step S108.

In step S107, the control section 31 performs a gift event process, and the processing proceeds to step S108. With reference to FIG. 16, a description is given below of the gift event process performed in the above step S107.

In FIG. 16, the control section 31 performs a gift content setting process (step S141), and the processing proceeds to the next step. For example, based on the gaining target gift data Dg and the event data De, the control section 31 generates an image indicating the content of a currently selected gift event (e.g., an image indicating gifts as gaining targets in the gift event; see FIGS. 5 and 7 to 11) and performs control to display the image on the display section 35 in the process of step S111 described below. Here, based on the gaining target gift data Dg, with respect to each of the gifts to be displayed on the display section 35, the control section 31 gives an image (an indicator T) indicating the type or the like of the gift (whether or not the gift is a gold gift), thereby generating an image. In the process of the above step S141, if an already gained gift is included in the gaining target gifts in the currently selected gift event, the control section 31 may generate an image indicating that the gift is already gained (e.g., an image in which the already gained gift is grayed out), and perform control to display the image on the display section 35.

Next, the control section 31 determines whether or not the process of acquiring a gift is to be performed (step S142). For example, based on the operation data acquired in the above step S103, if the operation of selecting an instruction using the operation button B1 (see FIGS. 7 and 10) is performed, the determination is affirmative in the above step S142. Then, if the process of acquiring a gift is to be performed, the processing proceeds to step S143. If, on the other hand, the process of acquiring a gift is not to be performed, the processing of this subroutine ends.

In step S143, the control section 31 determines whether or not the user owns a right to gain a gold gift. For example, with reference to the owned right data Dj, if the user owns the right (a gold pass) to gain a gold gift, the determination is affirmative in the above step S143. Then, if the user owns the right to gain a gold gift, the processing proceeds to step S144. If, on the other hand, the user does not own the right to gain a gold gift, the processing proceeds to step S145.

In step S144, the control section 31 performs the process in which the user acquires all the gifts as the gaining targets in the currently executed gift event, and the processing proceeds to step S146. For example, with reference to the gaining target gift data Dg, the control section 31 extracts all the gaining target gifts in the gift event represented by the currently selected gift object, changes the gaining target gifts to user-owned states, and adds the gaining target gifts to the owned gift data Dh. Then, in step S111 described below, the control section 31 performs control to display on the display section 35 an image indicating that all the gaining target gifts in the currently selected gift event are already gained (e.g., an image in which the already gained gifts are grayed out) and information indicating that all the gifts are acquired (see FIG. 11).

On the other hand, in step S145, the control section 31 performs the process in which the user acquires a non-gold gift as a gaining target in the currently executed gift event, and the processing proceeds to step S146. For example, with reference to the gaining target gift data Dg, the control section 31 extracts a non-gold gift among the gaining target gifts in the gift event represented by the currently selected gift object, changes the non-gold gift to a user-owned state, and adds the non-gold gift to the owned gift data Dh. Then, in step S111 described below, the control section 31 performs control to display on the display section 35 an image indicating that the non-gold gift among the gaining target gifts in the currently selected gift event is already gained (e.g., an image in which the already gained non-gold gift is grayed out) and information indicating that more gold gifts can be acquired by acquiring the gold pass (see FIG. 9).

In step S146, the control section 31 performs the process of changing the display form of the gift object, and the processing proceeds to the next step. For example, the control section 31 changes the display form of the currently selected gift object to an opened state (see FIGS. 8 and 11), thereby updating the state data Df2 related to the gift object.

Next, the control section 31 performs the process of moving the sequential position of the gift object (step S147), and the processing of this subroutine ends. For example, the control section 31 moves the currently selected gift object to the sequential position described with reference to FIG. 12 and the like and updates the sequential position data Df3 related to the gift object using the sequential position after the movement. The control section 31 aligns the sequential positions of the other placement objects after the movement of the gift object and updates the sequential position data Df3 using the sequential positions of the other placement objects after the alignment.

Referring back to FIG. 14, in step S108, the control section 31 determines whether or not the user is to newly acquire a right. For example, based on the operation data acquired in the above step S103, if the operation of selecting an instruction using the operation button B2 (see FIGS. 7 to 9) is performed, the determination is affirmative in the above step S108. Then, if the user is to newly acquire a right, the processing proceeds to step S109. If, on the other hand, the user is not to newly acquire a right, the processing proceeds to step S111.

In step S109, the control section 31 performs the process of allowing the user to acquire a new right (the gold pass), and the processing proceeds to the next step. For example, the control section 31 confirms via the server 200 that the condition under which the user acquires the new right (e.g., whether or not an equivalent is paid by charging or the like) is satisfied. If the condition is confirmed, the control section 31 gives the new right (the gold pass) to the user and also sets the valid period of the right, thereby updating the owned right data Dj. The control section 31 also changes parameters related to each gift (the type and the like of a gift object) to a gold pass owned state, thereby updating the placement object data Df and the like.

Next, the control section 31 performs a gold gift acquisition process (step S110), and the processing proceeds to step S111. For example, using the placement object data Df and the gaining target gift data Dg, the control section 31 extracts each gold gift that has not been gained in a gift event represented by a gift object in an opened state, changes the gold gift to a user-owned state, and adds the gold gift to the owned gift data Dh. In the above gold gift acquisition process, the control section 31 may perform control to display on the display section 35 an image for notifying the user of the newly gained gold gift in step S111 described below.

In step S111, the control section 31 performs a display control process for generating a display image and displaying the display image on the display section 35, and the processing proceeds to the next step. For example, in accordance with the player character data Dd, the event data De, the placement object data Df, the gaining target gift data Dg, the display range data Dk, and the like, the control section 31 performs the process of generating a display image corresponding to the processing results in the above steps S101 to S110 and displaying the display image on the display section 35. If the operation data acquired in the above step S103 indicates a user instruction to scroll the placement objects (e.g., a touch operation for sliding any of the placement objects to the left or right), in accordance with the user instruction, the control section 31 changes the display range of the placement objects, thereby updating the display range data Dk.

Next, the control section 31 performs a communication process (step S112), and the processing proceeds to the next step. As a first example, the control section 31 stores, in the transmission data Db, data indicating the play and execution results of each event (including the situation of the accumulation of gained points, the situation of the owning of a gift, the situation of the owning of a right, and the like). As a second example, the control section 31 stores, in the transmission data Db, data for making an inquiry to the server 200. Here, the data for making an inquiry to the server 200 is data for acquiring, from the server 200, data required as needed for the progress of the game processing and is data for making an inquiry to the server 200 to, for example, confirm that the condition under which the user acquires a new right is satisfied, confirm a right owned by the user, confirm the content of a gaining target gift in each gift event, and confirm the addition of a new event. As a third example, the control section 31 stores, in the transmission data Db, data to be transmitted to another information processing apparatus 3. Then, the control section 31 transmits transmission data stored in the transmission data Db to the server 200 via the network 100. The control section 31 also receives data from the server 200 via the network 100 and updates the reception data Dc using the received data. As an example, the control section 31 receives, from the server 200, reply data in response to an inquiry made to the server 200, data transmitted from another information processing apparatus 3, and the like and appropriately uses these pieces of data in the above game processing.

Next, the control section 31 determines whether or not the game processing is to be ended. Examples of a condition for ending the game processing include the satisfaction of a condition for ending the game processing, the fact that the user performs the operation of ending the game processing, and the like. If the game processing is to be continued, the processing returns to the above step S103, and the process of step S103 is repeated. If the game processing is to be ended, the processing indicated by the flow chart ends.

As described above, according to the information processing system 1 that performs the above game processing, even in the situation where in a gift event, some of gifts that can be gained are gained in the event, a gift object representing the gift event is changed to a position before a cup object placed at the top in the sequential order of placement objects or after a cup object placed at the end in the sequential order. Thus, it is easier to select a placement object representing another event than in a case where the gift object continues to be displayed at the same sequential position. Thus, it is possible to improve the convenience of selection of a placement object.

In the above description, the racing game has been used as an example of a subevent. The exemplary embodiment, however, can also be applied to the process of executing another game or information processing. For example, the exemplary embodiment can be applied to various processes such as the process of executing a competition game where a player character of a user and another character compete against each other in a sport or a fight, and the process of executing a game where only a player character of a user appears and clears stages.

The above game processing using the information processing system 1 includes the communication process between the information processing apparatus 3 and the server 200. Alternatively, the information processing apparatus 3 alone may perform game processing without being connected to the server 200. Particularly, the process in which the user performs the game by operating the player character PO and the process in which the user performs a gift event can be executed without the intervention of the server 200, and therefore can be achieved by only the internal processing of the information processing apparatus 3. For example, the information processing apparatus 3 alone may manage the content of a cup event, the content of a gift event, gained points, gifts, and the like. In this case, the server 200 may manage only information regarding a user-owned right including the situation of the charging of the user. Alternatively, even in a case where a game in which a plurality of information processing apparatuses 3 participate is performed, the above game processing may be achieved by the information processing apparatuses 3 communicating with each other or with another apparatus not via the server 200. Alternatively, the server 200 may execute a part of the process in which the user performs the game by operating the player character PO. Consequently, the server 200 can manage processing in a plurality of information processing apparatuses 3 in a concentrated manner.

The above descriptions have been given using an example where the information processing apparatus 3 performs information processing and a communication process. Alternatively, another apparatus may perform at least some of the processing steps in the above processing. For example, the server 200 capable of communicating with the information processing apparatus 3 and another apparatus (e.g., another server, another game apparatus, or another mobile terminal) may cooperate to perform the processing steps in the above processing. The server 200 or another apparatus may thus perform at least some of the processing steps in the above processing, thereby enabling processing similar to that described above. Further, the above processing can be performed by a processor or the cooperation of a plurality of processors, the processor or the plurality of processors included in an information processing system including at least one information processing apparatus. Further, in the above exemplary embodiment, the processing of the above flow charts is performed by the control section 31 of the information processing apparatus 3 executing a predetermined program. Alternatively, part or all of the processing of the flow charts may be performed by a dedicated circuit included in the information processing apparatus 3.

Here, according to the above variations, it is possible to achieve the exemplary embodiment also by a system form such as cloud computing, or a system form such as a distributed wide area network or a local area network. For example, in a system form such as a distributed local area network, it is possible to execute the processing between a stationary information processing apparatus (a stationary game apparatus) and a mobile information processing apparatus (a mobile game apparatus) by the cooperation of the apparatuses. It should be noted that, in these system forms, there is no particular limitation on which apparatus performs the steps of/in the above processing. Thus, it goes without saying that it is possible to achieve the exemplary embodiment by sharing the processing in any manner.

Further, the processing orders, the setting values, the conditions used in the determinations, and the like that are used in the information above processing are merely illustrative. Thus, it goes without saying that the exemplary embodiment can be achieved also with other orders, other values, and other conditions.

Further, each of the above programs may be supplied to the information processing apparatus 3 not only through an external storage medium such as an external memory, but also through a wired or wireless communication link. Further, the program may be stored in advance in a non-volatile storage device included in the information processing apparatus 3. It should be noted that examples of an information storage medium having stored therein the program may include CD-ROMs, DVDs, optical disk storage media similar to these, flexible disks, hard disks, magneto-optical disks, and magnetic tapes, as well as non-volatile memories. Alternatively, an information storage medium having stored therein the program may be a volatile memory for storing the program. It can be said that such a storage medium is a storage medium readable by a computer or the like. For example, it is possible to provide the various functions described above by causing a computer or the like to load a program from the storage medium and execute it.

While some exemplary systems, exemplary methods, exemplary devices, and exemplary apparatuses have been described in detail above, the above descriptions are merely illustrative in all respects, and do not limit the scope of the systems, the methods, the devices, and the apparatuses. It goes without saying that the systems, the methods, the devices, and the apparatuses can be improved and modified in various manners without departing the spirit and scope of the appended claims. It is understood that the scope of the systems, the methods, the devices, and the apparatuses should be interpreted only by the scope of the appended claims. Further, it is understood that the specific descriptions of the exemplary embodiment enable a person skilled in the art to carry out an equivalent scope on the basis of the descriptions of the exemplary embodiment and general technical knowledge. When used in the specification, the components and the like described in the singular with the word "a" or "an" preceding them do not exclude the plurals of the components. Furthermore, it should be understood that, unless otherwise stated, the terms used in the specification are used in their common meanings in the field. Thus, unless otherwise defined, all the jargons and the technical terms used in the specification have the same meanings as those generally understood by a person skilled in the art in the field of the exemplary embodiment. If there is a conflict, the specification (including definitions) takes precedence.

As described above, the exemplary embodiment is useful as, for example, an information processing system, an information processing program, an information processing apparatus, an information processing method, and the like in order, for example, to improve the convenience of selection of a placement object and the like.

What is claimed is:

1. An information processing system comprising a computer configured to at least:

place a plurality of placement objects including first objects each representing one of a plurality of game events of a first type and a second object representing at least one game event of a second type in a placement order in a game space;

generate an image including at least some of the placed plurality of placement objects to be displayed on a display screen;

at least based on satisfaction of an event accomplishment condition set for the game events of the first type or satisfaction of a subevent accomplishment condition set for subevents included in the game events of the first type, permit execution of the at least one game event of the second type; and in the game event of the second type permitted to be executed, giving a reward to a user based on whether a first or second giving condition is satisfied, the reward being a first reward if the first giving condition is satisfied, and the reward being a second reward if the second giving condition is satisfied, wherein:

the placement of the plurality of placement objects includes if the first reward is given to the user, not changing a placement order of the first objects only, and changing placement of the second object representing the game event of the second type in which the first reward is given to the user to a position before the first one of the first objects or after the last one of the first objects in the placement order, and even if the event accomplishment condition set for the game events of the first type is satisfied, or the subevent accomplishment condition set for the subevents included in the game events of the first type is satisfied, not changing the placement order of the first objects only that represent the game events of the first type, and the giving of the reward includes, after the placement of the second object is changed to the position before the first one of the first objects or after the last one of the first objects, and if the second giving condition in the game event of the second type represented by the second object is satisfied, giving the second reward in the game event of the second type to the user.

2. The information processing system according to claim 1, wherein the giving of the reward includes, at least under the condition that the execution of the game event of the second type is permitted, determining that the first giving condition is satisfied.

3. The information processing system according to claim 1, wherein the placement of the plurality of placement objects includes, if a plurality of the second objects are placed in the game space, and the first giving condition is satisfied in each of a plurality of the game events of the second type, changing the placement so that the plurality of the second objects each representing one of the game events of the second type are adjacent to each other in an area before the first one of the first objects or an area after the last one of the first objects.

4. The information processing system according to claim 1, wherein the computer is further caused to at least:

in the placement of the plurality of placement objects, place the plurality of first objects in ascending order of a number of a parameter required to permit execution of each of the game events of the first type represented by the plurality of first objects; and at least based on satisfaction of the event accomplishment condition set for any of the game events of the first type or the subevent accomplishment condition, change the number of the parameter corresponding to each of the plurality of first objects.

5. The information processing system according to claim 4, wherein the permission of the execution includes, based on the number of the parameter associated with each of users, permitting execution of at least one of the game events of the first type.

6. The information processing system according to claim 5, wherein the permission of the execution includes, at least based on the parameter that changes due to satisfaction of the event accomplishment condition set for the game event of the first type represented by any of the first objects placed on a side where a required number of the parameter is smaller in the placement order, or satisfaction of the subevent accomplishment condition set for the subevent included in the game event of the first type, permitting execution of the game event of the first type represented by any of the first objects placed on a side where the required number of the parameter is greater in the placement order and the game event of the second type represented by the second object.

7. The information processing system according to claim 6, wherein the generation of the image includes giving an image indicating a number that should be satisfied by the parameter for permitting the execution associated with each of the placed plurality of placement objects to each of the placement objects, thereby generating an image to be displayed on the display screen.

8. The information processing system according to claim 1, wherein the placement of the plurality of placement objects includes placing the second objects representing the game events of the second type satisfying the first giving condition in ascending order of a number of a parameter required to permit execution of each of the game events of the second type represented by the second objects, in an area before the first one of the first objects or an area after the last one of the first objects.

9. The information processing system according to claim 1, wherein the placement of the plurality of placement objects includes placing the plurality of placement objects in a line in the game space.

10. The information processing system according to claim 1, wherein the game events of the first type are permitted to be executed multiple times.

11. The information processing system according to claim 1, wherein the generation of the image includes generating an image including some of the plurality of placement objects to be displayed on the display screen by scrolling a display position on the display screen of a series of image groups of the plurality of placement objects relative to the display screen in accordance with a user operation.

12. The information processing system according to claim 1, wherein the placement of the plurality of placement objects includes, after the placement of the second object is changed to the position before the first one of the first objects or after the last one of the first objects, and if the second giving condition in the game event of the second type represented by the second object is satisfied, not changing a position of the second object in the placement order.

13. The information processing system according to claim 1, wherein the giving of the reward includes, in a period when a right given to the user is validated by the user paying an equivalent, determining that the second giving condition for the user is satisfied.

14. The information processing system according to claim 1, wherein the placement of the plurality of placement objects includes placing the second objects representing the game events of the second type in a display form in which with respect to each of the game events of the second type, it is visually distinguished whether or not the second giving condition is satisfied.

15. The information processing system according to claim 1, wherein the giving of the reward includes setting a time limit for giving the first reward and/or the second reward to the user for each of the game events of the second type.

16. The information processing system according to claim 1, wherein the generation of the image includes, in representation performed after the event accomplishment condition set for the game events of the first type or the subevent accomplishment condition is accomplished, generating an image for displaying the first objects representing the game events of the first type accomplishing the event accomplishment condition or the subevent accomplishment condition at least in the display screen.

17. The information processing system according to claim 1, wherein the generation of the image includes generating an image such that the placement of the second object is changed to the position before the first one of the first objects or after the last one of the first objects is outside the display screen.

18. The information processing system according to claim 1, wherein the game events of the first type include a plurality of game stages corresponding to the respective subevents.

19. A non-transitory computer-readable storage medium having stored therein an information processing program executable by a computer included in an information processing apparatus, the information processing program when executed being configured to cause the computer to perform operations comprising:

placing a plurality of placement objects including first objects each representing one of a plurality of game events of a first type and a second object representing at least one game event of a second type in a placement order in a game space;

generating an image including at least some of the placed plurality of placement objects to be displayed on a display screen;

at least based on satisfaction of an event accomplishment condition set for the game events of the first type or satisfaction of a subevent accomplishment condition set for subevents included in the game events of the first type, permitting execution of the at least one game event of the second type; and in the game event of the second type permitted to be executed, giving a reward to a user based on whether a first or second giving condition is satisfied, the reward being a first reward if the first giving condition is satisfied, and the reward being a second reward if the second giving condition is satisfied, wherein:

the placement of the plurality of placement objects includes, if the first reward is given to the user, a placement order of the first objects only is not changed, changing placement of the second object representing the game event of the second type in which the first reward is given to the user to a position before the first one of the first objects or after the last one of the first objects in the placement order, and even if the event accomplishment condition set for the game events of the first type is satisfied, or the subevent accomplishment condition set for the subevents included in the game events of the first type is satisfied, not changing the placement order of the first objects only that represent the game events of the first type, and the giving of the reward includes, after the placement of the second object is changed to the position before the first one of the first objects or after the last one of the first objects, and if the second giving condition in the game event of the second type represented by the second object is satisfied, giving the second reward in the game event of the second type to the user.

20. An information processing apparatus comprising a computer configured to at least:

place a plurality of placement objects including first objects each representing one of a plurality of game events of a first type and a second object representing at least one game event of a second type in a placement order in a game space;

generate an image including at least some of the placed plurality of placement objects to be displayed on a display screen;

at least based on satisfaction of an event accomplishment condition set for the game events of the first type or satisfaction of a subevent accomplishment condition set for subevents included in the game events of the first type, permit execution of the at least one game event of the second type; and in the game event of the second type permitted to be executed, giving a reward to a user based on whether a first or second giving condition is satisfied, the reward being a first reward if the first giving condition is satisfied, and the reward being a second reward if the second giving condition is satisfied, wherein:

the placement of the plurality of placement objects includes, if the first reward is given to the user, a placement order of the first objects only is not changed, changing placement of the second object representing the game event of the second type in which the first reward is given to the user to a position before the first one of the first objects or after the last one of the first objects in the placement order, and even if the event accomplishment condition set for the game events of the first type is satisfied, or the subevent accomplishment condition set for the subevents included in the game events of the first type is satisfied, not changing the placement order of the first objects only that represent the game events of the first type, and the giving of the reward includes, after the placement of the second object is changed to the position before the first one of the first objects or after the last one of the first objects, and if the second giving condition in the game event of the second type represented by the second object is satisfied, giving the second reward in the game event of the second type to the user.

21. An information processing method comprising:

placing a plurality of placement objects including first objects each representing one of a plurality of game events of a first type and a second object representing at least one game event of a second type in a placement order in a game space;

generating an image including at least some of the placed plurality of placement objects to be displayed on a display screen;

at least based on satisfaction of an event accomplishment condition set for the game events of the first type or satisfaction of a subevent accomplishment condition set for subevents included in the game events of the first type, permitting execution of the at least one game event of the second type; and in the game event of the second type permitted to be executed, giving a reward to a user based on whether a first or second giving condition is satisfied, the reward being a first reward if the first giving condition is satisfied, and the reward being a second reward if the second giving condition is satisfied, giving a second reward to the user, wherein:

the placement of the plurality of placement objects includes, if the first reward is given to the user, a placement order of the first objects only is not changed, changing placement of the second object representing the game event of the second type in which the first reward is given to the user to a position before the first one of the first objects or after the last one of the first objects in the placement order, and even if the event accomplishment condition set for the game events of the first type is satisfied, or the subevent accomplishment condition set for the subevents included in the game events of the first type is satisfied, not changing the placement order of the first objects only that represent the game events of the first type, and the giving of the reward includes, after the placement of the second object is changed to the position before the first one of the first objects or after the last one of the first objects, and if the second giving condition in the game event of the second type represented by the second object is satisfied, giving the second reward in the game event of the second type to the user.

* * * * *